United States Patent [19]

Ishigaki et al.

[11] Patent Number: 4,954,430

[45] Date of Patent: Sep. 4, 1990

[54] SILVER HALIDE PHOTOGRAPHIC ELEMENT WITH POLYESTER BASE

[75] Inventors: Kunio Ishigaki; Takashi Naoi, both of Kanagawa, Japan

[73] Assignee: Fuji Photo Film Co., Ltd., Kanagawa, Japan

[21] Appl. No.: 467,284

[22] Filed: Jan. 19, 1990

Related U.S. Application Data

[63] Continuation of Ser. No. 157,835, Feb. 19, 1988, abandoned.

[30] Foreign Application Priority Data

| | | | |
|---|---|---|---|
| Feb. 19, 1987 | [JP] | Japan | 62-36244 |
| Apr. 16, 1987 | [JP] | Japan | 62-94133 |
| Jun. 4, 1987 | [JP] | Japan | 62-140634 |
| Jul. 15, 1987 | [JP] | Japan | 62-176626 |

[51] Int. Cl.[5] ..... G03C 1/82

[52] U.S. Cl. ..... 430/534; 430/523; 430/533; 430/627

[58] Field of Search ..... 430/533, 534, 523, 527

[56] References Cited

U.S. PATENT DOCUMENTS

| | | | |
|---|---|---|---|
| 4,213,783 | 7/1980 | Cook | 430/533 |
| 4,254,208 | 3/1981 | Tatsuta et al. | 430/533 |
| 4,267,267 | 9/1981 | Ikenoue et al. | 430/533 |
| 4,287,298 | 9/1981 | Dodwell | 430/533 |
| 4,401,787 | 8/1983 | Chen | 430/533 |
| 4,407,938 | 10/1983 | Mizukura et al. | 430/533 |
| 4,609,617 | 9/1986 | Yamazaki et al. | 430/533 |
| 4,645,731 | 2/1987 | Bayless et al. | 430/533 |

*Primary Examiner*—Jack P. Brammer

*Attorney, Agent, or Firm*—Sughrue, Mion, Zinn, Macpeak & Seas

[57] ABSTRACT

A silver halide photographic material is disclosed, having at least one hydrophilic colloid layer comprising a polyester support and having a polymer latex on at least one side of said polyester support, wherein both surfaces of said support are coated with a polymer layer comprising a copolymer containing from 50 to 99.5% by weight vinylidene chloride and wherein both polymer layers have a thickness of at least 0.3 μm. A method for treating the silver halide photographic material is also disclosed.

6 Claims, No Drawings

SILVER HALIDE PHOTOGRAPHIC ELEMENT WITH POLYESTER BASE

This is a continuation of application No. 07/157,835 filed Feb. 19, 1988, now abandoned.

FIELDOF THE INVENTION

This invention relates to a silver halide photographic material having improved photographic layer(s), and, more particularly, to a silver halide photographic light-sensitive material having excellent dimensional stability. Further, the invention also relates to a method of treating such silver halide photographic materials.

BACKGROUND OF THE INVENTION

A silver halide photographic light-sensitive material is generally composed of a support having layer(s) containing a hydrophilic colloid such as gelatin, etc., as a binder on at least one surface thereof. Such a hydrophilic colloid layer, however, has a defect that the layer is liable to be stretched or shrunk with changes in humidity and/or temperature.

The dimensional change of a photographic light-sensitive material caused by stretching or shrinkage of the hydrophilic colloid layer causes serious defects in the case of a photographic light-sensitive material for printing, which is required to reproduce dot images for multicolor printing or precise line images.

For obtaining photographic light-sensitive materials undergoing less dimensional change, that is, having excellent dimensional stability, a technique of defining the ratio of the thickness of the hydrophilic colloid layer(s) and the thickness of the support is described in U.S. Pat. No. 3,201,250 and a technique of incorporating a polymer latex in the hydrophilic colloid layer(s) is described in Japanese Patent Publications. 4272/64, 17702/64, 13482/68, and 5331/70 and U.S. Pat. Nos. 2,763,625, 2,772,166, 2,852,386, 2,853,457, 3,397,988, 3,411,911 , and 3,411,912. The theoretical basis for the aforesaid techniques is given in J.Q. Umberger, *Photoqraghic Science and Engineering*, 69–73(1957).

However, the inclusion of such polymer latexes in hydrophilic colloid layers of photographic materials has a harmful influence on the film strength and abrasion resistance of the hydrophilic layers in processing solutions and the adhesionof these layers to supports in solutions.

A technique of overcoming the aforesaid problems involve with polymer latexes involves using a polymer having an active methylene group reactive with conventional gelatin hardening agents. It is described in U.S. Pat. Nos. 3,459,790, 3,488,708, 3,554,987, 3,700,456, 3,939,130, British Patent 1,491,701, etc. By the aforesaid techniques, the dimensional stability of photographic materials can be improved to some extent without reducing the film strength and abrasion resistance thereof in processing solutions. However, in multicolor printing or the printing wherein reproduction of precise line images is required, a further improvement of the dimensional stability of photographic light-sensitive materials has been strongly desired.

Also, a technique of improving the dimensional stability of photographic materials by using a support composed of a polyester film, both surfaces of which are coated with polyolefin, is disclosed in Japanese Patent Application (OPI) 3627/85 (the term "OPI" as used herein means an "unexamined published application"), but the improvement is insufficient for practical purposes.

Furthermore, methods using hydrazine derivatives for obtaining high contrast photographic characteristics are described in U.S. Pat. Nos. 4,224,401, 4,168,977, 4,166,742, 4,311,781, 4,272,606, 4,211,857, 4,243,739,etc. According to these methods, photographic light-sensitive materials having very high contrast and high sensitivity can be obtained. However, since in these methods the action of increasing contrast by hydrazine derivatives is hindered by using a large amount of polymer latex for improving the dimensional stability of the photographic material, whereby high-contrast photographic characeristics are not obtained, the amount of polymer latex is restricted for obtaining high-contrast characteristics and hence sufficient dimensional stability cannot be obtained.

The aforesaid technique of defining the ratio of the thickness of the hydrophilic colloid layer(s) and the thickness of the support can reduce the degree of stretching or shrinking of unprocessed or processed photographic films by changes in humidity.

However, the dimensional change of photograpbic films before and after processing steps (development, fix, wash, and drying) which are usually applied to photographic films cannot be prevented. This is because the support for the photographic film stretches by absorbing water in processing but it takes a long period of time to restore the stretched support to its original state even after drying,and the stretch is retained. Accordingly, the dimensions of a photographic film after processing are generally larger than those of the film before processing. This phenomenon is called "the dimensional stability with processing is bad" and is a serious defect, in particular, with photographic light-sensitive materials for printing.

The technique of incorporating a polymer latex in a hydrophilic colloid layer of a photographic light-sensitive material may reduce the stretching or shrinking due to changes in humidity to some extent, but cannot overcome the aforesaid problem since the support of the photographic material is impregnated with processing sulution at processing.

SUMMARY OF THE INVENTION

A first object of this invention is to provide a silver halide photographic material excellent in dimensional stability with the change of circumferential state such as humidity, temperature, etc., and also excellent in dimensional stability upon processing.

A second object of this invention is to provide a silver halide photographic material using one or more hydrazine derivatives for obtaining very high contrast, said photographic material being excellent in dimensional stability with the change of circumferential state and with processing.

A third object of this invention is to provide a silver halide photographic material having improved high film strength and abrasion resistance for the photosensitive layer(s) and the support in processing solutions, said photographic material being further excellent in dimensional stability with the change of circumferential state and with processing.

A forth object of this invention is to provide a method of treating the aforesaid silver halide photographic material in an optimum condition for keeping the dimensional stability of the photographic material.

It has been discovered that the aforesaid objects can be attained by the present invention as set forth hereinbelow.

The invention proves a silver halide photographic material comprising a polyester support having at least one hydrophilic colloid layer on at least one surface thereof, wherein both surfaces of said support are coated with a polymer layer comprising a copolymer containing from 50 to 99.5% by weight vinylidene chloride and having a thickness of at least 0.3 μm.

The invention also provides a method for preparing a silver halide photographic material comprising winding around a core the silver halide photographic material under such conditions that surface temperature of the coated layer of the photographic material being wound is from 40° to 50° C.

DETAILED DESCRIPTION OF THE INVENTION

The vinylidene chloride copolymer for use in this invention is a copolymer containing from 50 to 99.5% by weight, preferably from 70 to 99.5% by weight, and more preferably from 85 to 99% by weight, vinylidene chloride. The vinylidene chloride copolymer preferably has from 10,000 to 1000,000 of weight average molecular weight.

Examples thereof are copolymers composed of vinylidene chloride, an acrylic acid ester, and a vinyl monomer having alcohol at the side chain thereof as described in Japanese Patent Application (OPI) 135526/76, copolymers composed of vinylidene chloride, an alkyl acrylate, and acrylic acid as described in U.S. Pat. No. 2,852,378, copolymers composed of vinylidene chloride, acrylonitrile, and itaconic acid as described in U.S. Pat. No. 2,698,235, and copolymers composed of vinylidene chloride, an alkyl acrylate, and itaconic acid as described in U.S. Pat. No. 3,788,856. Other vinylidene chloride copolymer includes copolymers composed of vinylidene chloride and vinyl monomer having alcohol at the side chain thereof, copolymers composed of vinlydene chloride, alkylacrylate and methacrylic acid, copolymers composed of vinylidene chloride and itaconate, copolymers composed of vinylidene chloride, acrylonitrile and acrylic acid or methacrylic acid, copolymer composed of vinylidene chloride, alkylmethacrylate and vinyl monomer having alcohol at the side chain thereof, copolymers composed of vinylidene chloride, alkylacrylate or alkylmethacrylate and acrylamide, etc, wherein the alkyl group has preferably from 1 to 8 carbon atoms.

Specific exampels of the vinylidene chloride copolymers for use in this invention are illustrated below. The ratio in the parenthesis is weight ratio.

- Copolymer of vinylidene chloride, methyl acrylate, andhydroxyethyl acrylate (83 : 12 : 5)
- Copolymer of vinylidene chloride, ethyl methacrylate, hydroxypropyl acrylate (82 : 10 : 8)
- Copolymer of vinylidene chloride and hydroxyethyl methacrylate (92 : 8)
- Copolymer of vinylidene chloride, butyl acrylate, acrylic acid (94 : 4 : 2)
- Copolymer of vinylidene chloride, butyl acrylate, and itaconic acid (75 : 20 : 5)
- Copolymer of vinylidene chloride, methyl acrylate, and itaconic acid (90 : 8 : 2)
- Copolymer of vinylidene chloride, methyl acrylate, and methacrylic acid (93 : 4 : 3)
- Copolymer of vinylidene chloride and monoethyl taconate (96 : 4)
- Copolymer of vinylidene chloride, arylonitrile, and acrylic acid (96 : 3.5 : 1.5)
- Copolymer of vinylidene chloride, methyl acrylate, and acrylic acid (90 : 5 : 5)
- Copolymer of vinylidene chloride, methyl acrylate, and acrylic acid (92 : 5 : 3)
- Copolymer of vinylidene chloride, methyl acrylate, and 3-chloro-2-hydroxypropyl acrylate (84 : 9 : 7)
- Copolymer of vinylidene chloride, methyl acrylate, and N-ethanolacrylamide (85 : 10 : 5)
- Copolymer of vinylidene chloride, methyl methacrylate, and acrylonitrile (85 : 8 : 7)
- Copolymer of vinylidene chloride, methyl methacrylate and acrylonitrile (90 : 7 : 3)
- Copolymer of vinylidene chloride, methyl methacrylate, and acrylonitrile (90 : 5 : 3)

For coating a polyester support with the vinylidene chloride copolymer in this invention, a solution of the copolymer in an organic solvent or an aqueous dispersion preferably of from 10 to 20 wt% of the copolymer is coated on the support by a coating method well known in the art, such as a dip coating method, an air knife coating method, a curtain coating method, a roller coating method, a wire bar coating method, a gravure coating method, or an extrusion coating method using a hopper as described in U.S. Pat. No. 2,681,294. Also, a casting method of casting the molten polymer on the travelling polyester film in film form and laminating the copolymer film onto the polyester film under pressure while cooling may be employed. The solvent to obtain a solution of the copolymer includes preferably furans such as tetrahydrofuran etc., ketones such as methylethylketon, acetone, etc., esters such as ethylacetate, butylacetate, etc., hydrocarbons, such as toluene, etc. chloride such as carbontetrachloride, etc., alcohols such as ethanol, isopropanol, etc.

For improving the adhesion of the polyester support to the copolymer layer, the surfaces of the polyester support may be subjected to a chemical treatment, mechanical treatment, corona discharge treatment, flame treatment, ultraviolet treatment, high frequency treatment, glow dischange treatment, active plasma treatment, high-pressure steam treatment, desorbing treatment, laser treatment, mixed acid treatment, ozone oxidation treatment, etc.

Also, for increasing the adhesion of the aforesaid polymer layer to the polyester base, a swelling agent for the polyester, such as phenol and resorcin as described in U.S. Pat. Nos. 3,245,937, 3,143,421, 3,501,301, 3,271,178, etc., as well as o-cresol, m-cresol, trichloroacetic acid, dichloroacetic acid, monochloroacetic acid, chloral hydrate, benzyl alcohol, etc., may be added to the copolymer and as such a swelling agent, divalent phenol, e.g., resorcin is preferably used. The swelling agent is preferably used in an amount of 0.1 to 5 wt% based on vinylidene chloride. However, resorcin has the disadvantage of frequently causing spot troubles in the production of the photographic light-sensitive material.

Thus, in a particularly preferred method for improving adhesion between the polyester support and the copolymer layer without the aforesaid disadvantage, the surface(s) of the polyester support is/are subjected to a glow discharge treatment and then the copolymer layer is formed thereon.

For the glow discharge treatment, the methods described, for example, in Japanese Patent Publications 7578/60, 10336/61, 22004/70, 22005/70, 24040/70, 43480/71, U.S. Pat. Nos. 3,057,792, 3,057,795, 3,179,482, 3,288,638, 3,309,299, 3,424,735, 3,462,335, 3,475,307,3,761,299, British Patent 997,093, and Japanese Patent Application (OPI) 129262/78 can be used.

The pressure in the glow discharge system is from 0.005 to 20 Torr, and preferably from 0.02 to 2 Torr. If the pressure is lower than the aforesaid range, the surface treatment effect for the support is reduced and if the pressure is higher than the aforesaid range, excessive electric current is passed to cause sparks, which causes the possibility of damaging the polyester support udner treatment.

Glow discharge occurs by applying a high electrical potential to a pair of metal plates or metal rods disposed at a definite interval in a vacuum tank. The electric potential depends upon the composition and pressure of the gases used but usually, stable and constant glow discharge occurs at a potential of from 500 volts to 5,000 volts in the aforesaid pressure range. A potential range particularly suitable for increasing adhesion is from 2,000 volts to 4,000 volts.

Also,the discharge frequency is from direct current to several thousands MHz, and preferably from 50 Hz to 20 MHz. The discharge treatment strength for obtaining a desired adhesive strength is from 0.01 KV/amp.min./$m^2$ to 5 KV.amp.min./$m^2$, and preferably from 0.05 KV.amp.min./$m^2$ to 1 KV.amp.min./$m^2$.

The thickness of the vinylidene chloride copolymer layer in this invention is preferably relatively thick for restraining stretching of the base film by adsorbing water during processing, but if the thickness is too great the adhesion for a silver halide emulsion layer formed thereon is reduced. Accordingly, the thickness of the copolymer layer is generally in the range of from 0.3 μm to 5 μm, and preferably from 0.5 μm to 3.0 μm.

The polyester used as a support in this invention is a polyester mainly composed of an aromatic dibasic acid and a glycol. Typical examples of the dibasic acid are terephthalic acid, isophthalic acid, p-β-oxyethoxybenzoic acid, diphenylsulfondicarboxylic acid, diphenoxyethanedicarboxylic acid, adipic acid, sebacic acid, azelaic acid, 5-sodiumsulforisophthalic acid, diphenylenedicarboxylic acid, and 2,6-naphthalenedicarboxylic acid. Typical examples of the glycol are ethylene glycol, propylene glycol, butanediol, neopentylene glycol, 1,4-cyclohexane diol, 1,4-cyclohexane dimethanol, 1,4-bisoxyethoxybenzene, bisphenol A, diethylene glycol, and polyethylene glycol.

Polyethylene terephthalate is most convenient for use in this invention from the view point of availability.

There is no particular restriction on the thickness of the polyester support but the thickness is advantageously from about 12 μm to about 500 μm, and preferably from about 40 μm to about 200 μm from the points of ease of handling and wideness of availability. Biaxially oriented polyester films are particularly preferred from that view points of stability and strength.

In this invention, for improving the adhesive strength between the copolymer layer and a silver halide emulsion layer, a subbing layer having good adhesive property for both layers and giving no disadvantageous influences on photographic properties may be formed on the copolymer layer. Also, for further improving the adhesion between both layers, the surface of the copolymer layer may be subjected to a pre-treatment such as corona discharge, ultraviolet irradiation, flame treatment, etc. Preferable subbing layer is transparent and comprises gelatin.

The hydrophilic colloid layer of the photographic light sensitive material of this invention includes silver halide emulsion layer(s), a back layer, a protective layer, an interlayer, etc., and for these layer, a hydrophilic colloid is used. As the hydrophilic colloid, gelatin is most preferable and as the gelatin, limed gelatin, acid-treated gelatin, enzyme-treated gelatin derivatives, denatured gelatin, etc., which are generally used in the photographic arts can be used, but of these gelatins, limed gelatin and acid-treated gelatin are preferably used.

Also, hydrophylic colloids other than gelatin can be used in this invention. Examples of such other hydrophilic colloids are proteins such as colloidal albumin, casein, etc.; cellulose compoudns such as carboxymethyl cellulose, hydroxyethyl cellulose, etc.; saccharose derivatives such as agar agar, sodium alginate, starch derivatives, etc.; and synthetic hydrophilic colloids such as polyvinyl alcohol, poly-N-vinylpyrrolidone, polyacrylic acid copolymers, polyacrylamide, and the derivatives and partially decomposed products thereof. They can be used singly or as a mixture of two or more kinds thereof.

The hydrophilic colloid layer of the photographic light-sensitive material of this invention contains a polymer latex. The polymer latex is an aqueous dispersion of water-insoluble polymer particles having a mean particle size of from 20 mμ to 200 mμ. The amount of the polymer latex is preferably from 0.01 to 1.0, and particularly preferably from 0.01 to 1.0, part by weight per 1.0 part by weight of the binder (such as gelatin) in the hydrophilic colloid layer.

The polymer latex which is used in this invention preferably has at least one monomer represented by following formulae (P - I) to (P - XVIII) as a recuring unit.

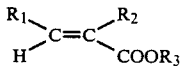
(P-I)

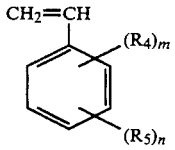
(P-II)

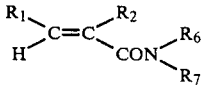
(P-III)

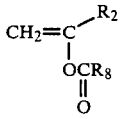
(P-IV)

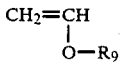
(P-V)

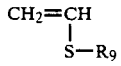
(P-VI)

-continued

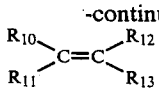
(P-VII)

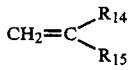
(P-VIII)

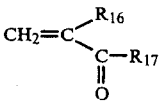
(P-IX)

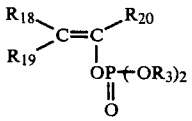
(P-X)

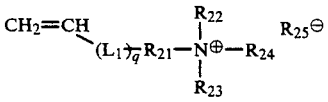
(P-XI)

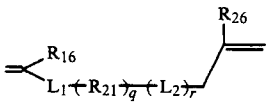
(P-XII)

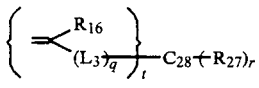
(P-XIII)

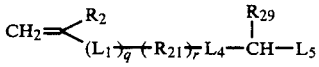
(P-XIV)

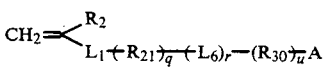
(P-XV)

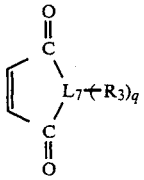
(P-XVI)

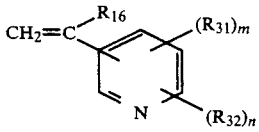
(P-XVII)

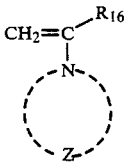
(P-XVIII)

In the above formulae, $R_1$ represents a hydrogen atom, a carboxy group or a salt of carboxy group.

$R_2$ represents a hydrogen atom, an alkyl group, a substituted alkyl group, a halogen atom, a carboxy group, or a cyano group;

$R_3$ represents a hydrogen atom, an alkyl group, a substituted alkyl group, a cycloalkyl group, an aryl group, or substituted aryl group, wherein the substituent preferably includes an epoxy group, an alkyl group, an alkoxy group, a halogen atom, $-SO_3Na$, an amino group, a polyoxyethylene group, a hydroxy group, a carboxy group, a $-OPO(OH)_2$ group.

$R_4$ and $R_5$, which may be the same or different, each represents a hydrogen atom, an alkyl group, a substituted alkyl group, a carboxy group or a salt thereof, —COOR3 (herein $R_3$ is same as defined above), a halogen atom, a hydroxy group or a salt thereof, a cyano group, $-SO_3R_3'$, $-SO_2R_3'$ ($R_3'$ represents an alkyl group having from 1 to 8 carbon atoms, or Na or K) or a carbamoyl group;

m represents 0, 1 or 2;

n represents 0, 1 or 2;

$R_6$ and $R_7$, which may be the same or different, each represents a hydrogen atom, an alkyl group, a substituted alkyl group, a phenyl group, or a substituted phenyl group, wherein the substituent preferably includes a thioalkoxy group, an alkoxycarbonyl group, a hydroxy group,

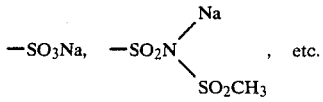

$R_8$ represents an alkyl group, a substituted alkyl group, preferably substituted by a group such as a halogen atom, a thioalkoxy group, etc, a phenyl group, or a substituted phenyl group;

$R_9$ represents an alkyl group or a substituted alkyl group;

$R_{10}$, $R_{11}$, $R_{12}$, and $R_{13}$, which may be the same or different, each represents a hydrogen atom, an alkyl group, a substituted alkyl group, a halogen atom, or a cyano group;

$R_{14}$ represents a hydrogen atom, an alkyl group, or a halogen atom;

$R_{15}$ represents an alkenyl group;

$R_{16}$ represents a hydrogen atom, an alkyl group, or a substituted alkyl group;

$R_{17}$ represents an alkyl group or a substituted alkyl group;

$R_{18}$ represents a hydrogen atom, an alkyl group, or an alkenyl group;

$R_{19}$ and $R_{20}$ which may be the same or different, each represents a hydrogen atom or an alkyl group;

$R_{21}$ represents an alkylene group, a substituted alkylene group or $(CH_2)_xO(CH_2)_yO_w(CH_2)_v$ (wherein x, y, w, and v represent 0 or 1);

$L_1$ represents —COO—, a phenylene group, or

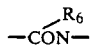

(wherein $R^6$ is same as defined above);

q represents 0 or 1; when q is 0, $R_{21-N}$ may form a pyridine ring;

$R_{22}$, $R_{23}$, and $R_{24}$, which may be the same or different, each represents an alkyl group or a substituted alkyl group;

$R_{25}\ominus$ represents an anion;

$R_{26}$ represents a hydrogen atom, an alkyl group, or a substituted alkyl group;

$L_1$ and $L_2$, which may be the same or different, each represents $$-COO-,\quad -CON\overset{R_6}{<}$$

wherein $R_6$ is same as defined above), —O—, —S—, —OOC—, —CO—, a phenylene group or a substituted phenylene group;

r represents 0 or 1;

$L_3$ represents $$-COO-,\quad -CON\overset{R_6}{<}$$

(wherein $R_6$ is same as defined above), or —OOC—;

$R_{27}$ represents a hydrogen atom, an alkyl group, or a substituted alkyl group;

t represents 3 or 4;

$C_{28}$ represents a carbon atom, $$-\overset{|}{CH}-,$$

or a heterocyclic ring preferably containing at least one of O, N and S;

$L_4$ represents $$-OOC-,\quad -CO-,\quad -\overset{R_6}{\overset{|}{N}}-\underset{\underset{O}{\|}}{C}-$$

(wherein $R_6$ is same as defined above), or $$-CON\overset{R_6}{<}$$

wherein $R_6$ is same as defined above);

$L_5$ represents —CO—$R_{17}$ (wherein $R_{17}$ is same as defined above), —COO$R_{17}$ (wherein $R_{17}$ is same as defined above), a cyano group, $$-CON\overset{R_6}{<}$$

(wherein $R_6$ is same as defined above), or —$SO_2$—$R_{17}$ (wherein $R_{17}$ is same as defined above);

$R_{29}$ represents a hydrogen atom or —CO—$R_{17}$ (wherein $R_{17}$ is same as defined above);

$L_6$ represents $$-\underset{\underset{O}{\|}}{NHCNHC}-,\quad -\underset{\underset{R_{16}}{|}}{N}-$$

(wherein $R_6$ is same as defined above), —NHCNH—, or $$-N\overset{R_6}{<}\underset{\underset{O}{\|}}{C}-$$

(wherein $R_6$ is same as defined above);

$L_7$ represents an oxygen atom or a nitrogen atom;

$R_{30}$ represents an alkylene group or a triazole ring;

A represents a halogen atom or an amino group but when $R_{30}$ is a triazole ring, A may represent two or more halogen atoms;

$R_{31}$ and $R_{32}$, which may be the same or different, each represents a hydrogen atom, an alkyl group, a substituted alkyl group, a hydroxy group or salt thereof, e.g., —ONa, etc. an amino group, a carboxy group or a salt thereof, or a cyano group; and Z represents a constitution element forming a heterocyclic ring having from 3 to 13 carbon atoms together with N.

The alkyl group, the alkenyl group and the cycloalkyl group described above each preferably has from 1 to 8 carbon atoms.

Preferable carbon numbers of the groups described above are selected so that the weight average molecular weight of the polymer latex is from 100,000 to 400,000.

Examples of the monomer shown by formula (P - I) described above are illustrated below:

| Monomer No. | $R_1$ | $R_2$ | $R_3$ |
|---|---|---|---|
| M-1 | H | H | H |
| M-2 | H | H | $-CH_3$ |
| M-3 | H | H | $-C_2H_5$ |
| M-4 | H | H | $-C_3H_7(n)$ |
| M-5 | H | H | $-C_4H_9(n)$ |
| M-6 | H | H | $-CH_2CH\underset{O}{\diagup\diagdown}CH_2$ |
| M-7 | H | H | $-C_6H_{12}(n)$ |
| M-8 | H | H | $-C_{16}H_{37}(n)$ |
| M-9 | H | H | $-CH(CH_2CH_3)_2$ |
| M-10 | H | H | 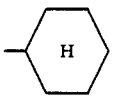 |
| M-11 | H | H | 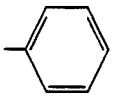 |
| M-12 | H | H | $-CH_2CH_2CH_2SO_3Na$ |

-continued

| Monomer No. | $R_1$ | $R_2$ | $R_3$ |
|---|---|---|---|
| M-13 | H | H | $-CF_2CF_2CF_2CF_2H$ |
| M-14 | H | H | $-CH_2CH_2OCH_3$ |
| M-15 | H | H | $-CH_2CH_2OC_2H_5$ |
| M-16 | H | H | $-CH_2CH_2SCH_2$ |
| M-17 | H | H | $-CH_2CH_2CN$ |
| M-18 | H | H | 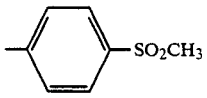 |
| M-19 | H | H | $-CH_2CH_2N(C_2H_5)_2$ |
| M-20 | H | H | $-CH_2CH_2-(OCH_2CH_2)_8-OH$ |
| M-21 | H | H | $-CH_2CH_2-O\overset{\overset{O}{\|}}{\underset{\underset{OH}{\|}}{P}}-OH$ |
| M-22 | H | $CH_3$ | H |
| M-23 | H | $CH_3$ | $-C_2H_5$ |
| M-24 | H | $CH_3$ | $-C_2CH_2OH$ |
| M-25 | H | $CH_3$ | $-CH_2CH_2OOCCH_2CH_2COOH$ |
| M-26 | H | $-Cl$ | $-H$ |
| M-27 | H | $-COOH$ | $-H$ |
| M-28 | $-COOH$ | H | H |
| M-29 | $-COOH$ | Cl | H |
| M-30 | H | $-CH_2COOH$ | $CH_3$ |

Example of the monomer shown by formula (P - II) described above are as follows:

| Monomer No. | $R_4$ | $R_5$ |
|---|---|---|
| M-31 | H | H |
| M-32 | p-COOH | H |
| M-33 | p-Cl | H |
| M-34 | m-Cl | p-Cl |
| M-35 | p-$SO_2CH_3$ | H |
| M-36 | o-$SO_3C_2H_5$ | p-$SO_3C_2H_5$ |
| M-37 | o-$CH_3$ | H |

-continued

| Monomer No. | $R_4$ | $R_5$ |
|---|---|---|
| M-38 | $-SO_3Na$ | H |
| M-39 | $-SO_3K$ | H |
| M-40 | m-$CH_{22}OC\overset{\overset{O}{\|}}{C}H_3$ | H |

Examples of the monomer shown by formula (P - III) described above are illustrated below.

| Monomer No. | $R_1$ | $R_2$ | $R_6$ | $R_7$ |
|---|---|---|---|---|
| M-41 | H | H | H | $-C_3H_7$ (iso) |
| M-42 | H | H | $-C_2H_5$ | $-C_2H_5$ |
| M-43 | H | H | H | $-CH_2CH_2SCH_3$ |
| M-44 | H | H | H | $-CH_2COOC_2H_5$ |
| M-45 | H | H | $-\overset{\overset{CH_3}{\|}}{C}HCH_2SCH_3$ | $-\overset{\overset{CH_3}{\|}}{C}HCH_2SCH_3$ |
| M-46 | H | $CH_3$ | H | 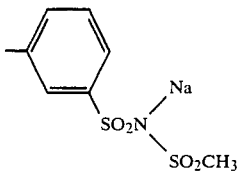 |
| M-47 | H | $CH_3$ | H | 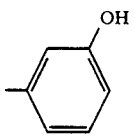 |
| M-48 | H | $CH_3$ | $-CH_2CN$ | $-CH_2CN$ |
| M-49 | $-CH_2CH_2N(CH_3)_2$ | $CH_3$ | H | H |
| M-50 | H | H | H | H |

-continued

| Monomer No. | $R_1$ | $R_2$ | $R_6$ | $R_7$ |
|---|---|---|---|---|
| M-51 | H | H | H | $-C(CH_3)_2CH_2SO_3Na$ |

Examples of the monomer shown by formula (P - IV) described above are illustrated below:

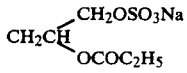
M-52

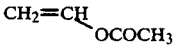
M-53

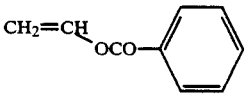
M-54

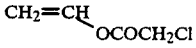
M-55

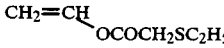
M-56

Examples of the monomer shown by formula (P - V) described above are illustrated below:

$CH_2=CH-OCH_3$ M-57

$CH_2=CH-OC_4H_9(n)$ M-58

Examples of the monomer shown by formula (P - VI) described above are illustrated below:

$CH_2=CH-S-CH_2CH_2CH_2SCH_3$ M-59

$CH_2=CH-S-CH_2SCH_3$ M-60

Examples of the monomer shown by formula (P - VII) described above are illustrated below:

$CH_2=CHCN$ M-61

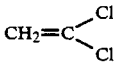
M-62

$ClCH_2=CCl_2$ M-63

Examples of the monomer shown by formula (P - VIII) described above are illustrated below:

$CH_2=CHCH=CH_2$ M-64

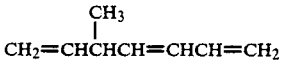
M-65

Examples of the monomer shown by formula (P - IX) are illustrated below:

$CH_2=CHCOCH_3$ M-67

-continued

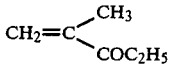
M-68

Examples of the monomer shown by formula (P - X) are illustrated below:

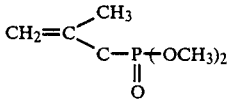
M-69

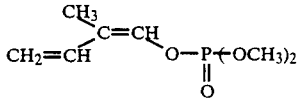
M-70

Examples of the monomer shown by formula (P - XI) are illustrated below:

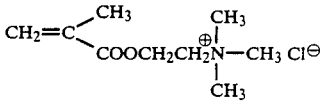
M-71

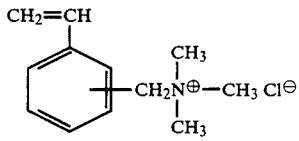
M-72

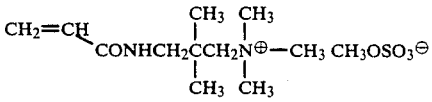
M-73

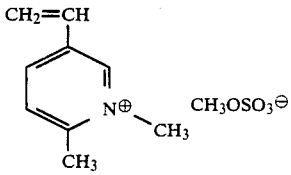
M-74

Examples of the monomer shown by formula (P - VII) described above are illustrated below:

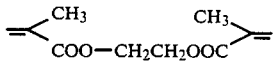
M-75

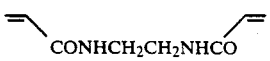
M-76

-continued

M-77

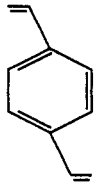

M-78

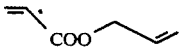

M-79

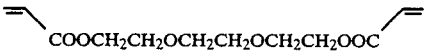

M-80

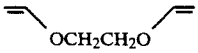

Examples of the monomer shown by formula (P - XIII) described above are illustrated below:

M-81

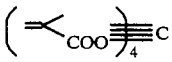

M-82

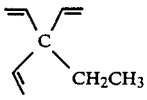

M-83

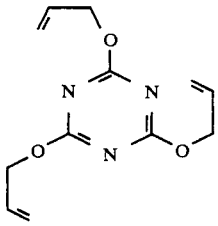

M-84

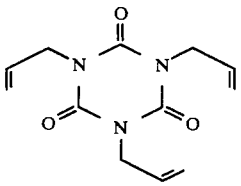

Examples of the monomer shown by formula (P - XIV) described above are illustrated below:

M-85

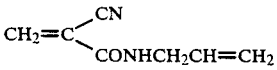

M-86

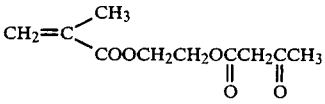

M-87

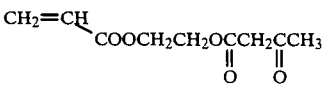

M-89

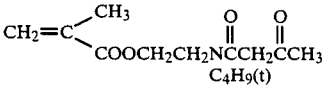

-continued

M-90

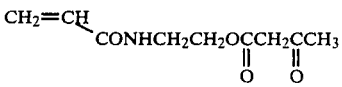

Examples of the monomer shown by formula (P - XV) described above are illustrated below:

M-91

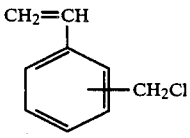

M-92

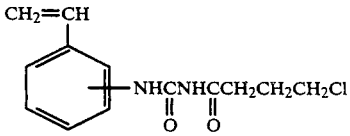

M-93

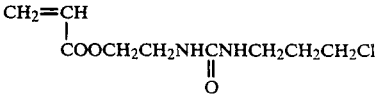

M-94

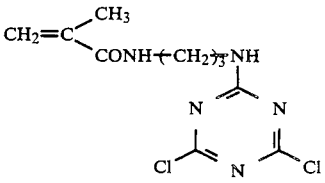

M-95

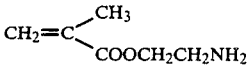

Examples of the monomer shown by formula (P - XVI) described above are illustrated below:

M-96

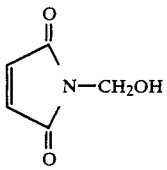

M-97

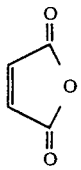

Examples of the monomer shown by formula (P - XVII) described above are illustrated below:

M-98

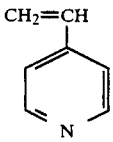

-continued

M-99

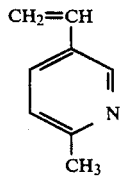

Examples of the monomer shown by formula (P - XVIII) described above are illustrated below:

M-100

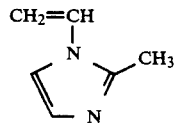

M-101

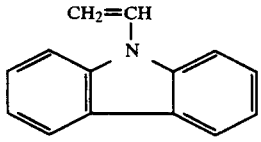

M-102

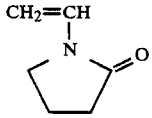

Examples of the polymer latex for use in this invention are shown in the following table.

$\text{-}(M_1)_a\text{-}(M_2)_b\text{-}(M_3)_c\text{-}(M_4)_d\text{-}$ ($M_1$, $M_2$, $M_3$ and $M_4$ each represents a monomer unit) a/b/c/d (Molar ratio)

| Polymer Latex No. | $M_1$ | a | $M_2$ | b | $M_3$ | c | $M_4$ | d |
|---|---|---|---|---|---|---|---|---|
| E-1 | M-3 | 1.0 | | | | | | |
| E-2 | M-1 | 0.05 | M-3 | 0.95 | | | | |
| E-3 | M-1 | 0.2 | M-75 | 0.8 | | | | |
| E-4 | M-3 | 0.85 | M-12 | 0.15 | | | | |
| E-5 | M-1 | 0.08 | M-61 | 0.27 | M-5 | 0.65 | | |
| E-6 | M-3 | 0.7 | M-61 | 0.3 | | | | |
| E-7 | M-1 | 0.04 | M-3 | 0.68 | M-31 | 0.28 | | |
| E-8 | M-5 | 0.58 | M-22 | 0.08 | M-31 | 0.24 | M-98 | 0.10 |
| E-9 | M-5 | 0.40 | M-31 | 0.60 | | | | |
| E-10 | M-3 | 0.78 | M-22 | 0.22 | | | | |
| E-11 | M-1 | 0.40 | M-14 | 0.40 | M-77 | 0.20 | | |
| E-12 | M-5 | 0.95 | M-51 | 0.05 | | | | |
| E-13 | M-5 | 0.90 | M-51 | 0.10 | | | | |
| E-14 | M-31 | 0.90 | M-51 | 0.10 | | | | |
| E-15 | M-5 | 0.80 | M-51 | 0.10 | M-77 | 0.10 | | |
| E-16 | M-5 | 0.30 | M-31 | 0.65 | M-51 | 0.05 | | |
| E-17 | M-31 | 0.45 | M-22 | 0.45 | M-51 | 0.10 | | |
| E-18 | M-5 | 0.80 | M-41 | 0.10 | M-51 | 0.10 | | |
| E-19 | M-5 | 0.20 | M-50 | 0.30 | M-51 | 0.45 | M-51 | 0.05 |
| E-20 | M-5 | 0.95 | M-39 | 0.05 | | | | |
| E-21 | M-2 | 1.0 | | | | | | |
| E-22 | M-61 | 1.0 | | | | | | |
| E-23 | M-62 | 0.88 | M-22 | 0.10 | M-27 | 0.02 | | |
| E-24 | M-3 | 0.25 | M-22 | 0.02 | M-27 | 0.73 | | |
| E-25 | M-1 | 0.08 | M-61 | 0.27 | M-14 | 0.65 | | |
| E-26 | M-1 | 0.08 | M-61 | 0.27 | M-15 | 0.65 | | |
| E-27 | M-3 | 0.67 | M-61 | 0.29 | M-1 | 0.04 | | |
| E-28 | M-1 | 0.04 | M-5 | 0.67 | M-31 | 0.29 | | |
| E-29 | M-5 | 0.56 | M-19 | 0.13 | M-22 | 0.07 | M-31 | 0.24 |
| E-30 | M-3 | 0.63 | M-19 | 0.07 | M-22 | 0.03 | M-31 | 0.27 |
| E-31 | M-50 | 0.16 | M-5 | 0.28 | M-31 | 0.52 | M-98 | 0.04 |
| E-32 | M-22 | 0.50 | M-64 | 0.50 | | | | |
| E-33 | M-50 | 0.20 | M-3 | 0.80 | | | | |

-continued $\text{-}(M_1)_a\text{-}(M_2)_b\text{-}(M_3)_c\text{-}(M_4)_d\text{-}$ ($M_1$, $M_2$, $M_3$ and $M_4$ each represents a monomer unit) a/b/c/d (Molar ratio)

| Polymer Latex No. | $M_1$ | a | $M_2$ | b | $M_3$ | c | $M_4$ | d |
|---|---|---|---|---|---|---|---|---|
| E-34 | M-50 | 0.30 | M-1 | 0.10 | M-3 | 0.60 | | |
| E-35 | M-50 | 0.20 | M-1 | 0.20 | M-5 | 0.60 | | |
| E-36 | M-50 | 0.30 | M-43 | 0.70 | | | | |
| E-37 | M-16 | 1.0 | | | | | | |
| E-38 | M-31 | 0.55 | M-64 | 0.40 | M-1 | 0.05 | | |
| E-39 | M-53 | 0.80 | M-2 | 0.10 | M-1 | 0.10 | | |
| E-40 | M-3 | 0.90 | M-20 | 0.10 | | | | |

With respect to the polymer latex used in this invention, the desclosures of U.S. Pat. Nos. , 3,986,877, 3,516,830, 3,533,793, *Research Disclosure* 15649, U.S. Pat. Nos. 3,635,713, 3,397,988, 3,647,459, 3,607,290, 3,512,985, 3,536,491, 3,769,020, 3,874,327, 2,376,005, 2,768,080, 2,772,166, 2,808,388, 2,835,582, 2,852,386, 2,853,457, 2,865,753, British Patents 1,358,885, 1,186,699, U.S. Pat. Nos. 3,592,655, 3,411,911, 3,411,912, 3,459,790, 3,488,708, 3,700,456, 3,939,130, 3,544,987, 3,507,661, 3,508,925, British Patents 1,316,541, 1,336,061, 1,491,701, 1,498,697, *Research Disclosure* 14739, U.S. Pat. No. 3,620,751, Research Disclosure 15638, British Patents 1,401,768, 1,623,522, U.S. Pat. Nos. 3,635,715, 3,967,965, 3,142,568, 3,252,801, 3,625,689, 3,632,342, 2,887, 380, 2,721,801, 2,875,054, 3,021,214, 3,793,029, *Research Disclosure* 11906, *ibid.*, 15235 ibid., 16250, etc., are incorporated by reference.

The polymer latex in this invention is incorporated in at least one hydrophilic colloid layer such as a silver halide emulsion layer(s), a back layer, a protective layer, an interlayer, etc.

The effect of this invention is particularly remarkable in the photographic light-sensitive material of very high contrast containing a hydrazine derivative.

The photosensitive light-sensitive materials of very high contrast containing such hydrazine derivatives and processes for forming images using such light-sensitive materials are described in U.S. Pat. Nos. 4,224,401, 4,168,977, 4,166,742, 4,241,164, and 4,272,606 and Japanese Patent Applications (OPI) 83028/85, 218642/85, 258537/85, 223738/86, etc., incorporated by reference. Hydrazine derivative is used in an amount of from $10^{-6}$ to $10^{-1}$ mol per mol of silver halide.

As the hydrazine derivatives for use in this invention, the compounds shown by formula (I) are preferably used;

$$A-\underset{\underset{X}{|}}{N}-\underset{\underset{Y}{|}}{N}-B \qquad (I)$$

wherein A represents an aliphatic group or an aromatic group; B represents a formyl group, an acyl goup, an alkylsulfonyl group, an arylsulfonyl group, an alkylsulfiniyl group, an arylsulfinyl group, a carbamoyl group, an alkoxycarbonyl group, an aryloxycarbonyl group, a sulfamoyl group, an alkoxysulfony group, a thioacyl group, a thiocarbamoyl group, a sulfanyl group, or a heterocyclic group; and X and Y both represent a hydrogen atom or one of them represents a hydrogen atom and the other represents a substituted or unsubstituted alkylsulfonyl group, a substituted or unsubstituted arylsulfonyl group, or a substituted or unsubstituted acyl group.

Typical examples of the compound shown by formula (I) described above are illustrated below.

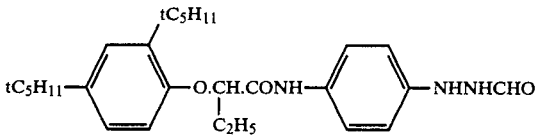

(I-1)

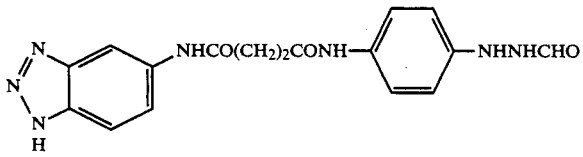

(I-2)

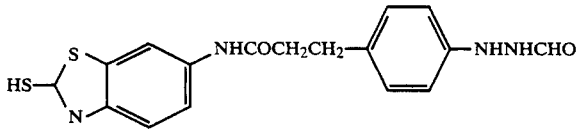

(I-3)

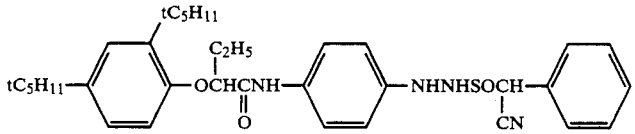

(I-4)

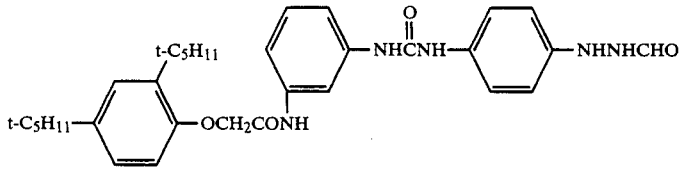

(I-5)

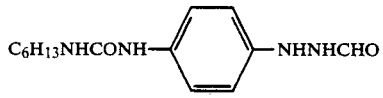

(I-6)

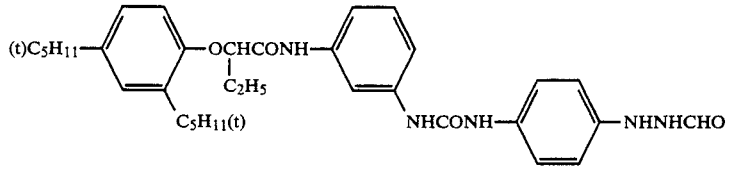

(I-7)

Moreover, the present invention is also effective in a process for obtaining high contrast e.g., 10 or more of $\gamma$ value by processing a photographic light-sensitive material containing a tetrazolium compound with a PA type developer containing hydroquinone as a developing agent and phenidone as a subsidiary developing agent or MO type developer containing hydroquinone as a developing agent and methol as a subsidiary developing agent, which contains a sulfite at a relatively high concentration e.g., 0.15 mol/l or more.

A process of forming images using a light-sensitive material containing a tetrazolium compound is described in Japanese Patent Applications (OPI) 18317/77, 17719/78, 17720/78, etc., incorporated by reference.

The silver halide emulsion for the photographic light-sensitive material of this invention is usually prepared by mixing an aqueous solution of a water-soluble silver salt (e.g., silver nitrate) and an aqueous solution of a water-soluble halide (e.g., potassium bromide) in the presence of an aqueous solution of a water-soluble polymer such as gelatin.

As the silver halide (silver salt), silver chloride, silver bromide, silver chlorobromide, silver iodobromide, or silver chloroiodo-bromide can be used and there are no particular restrictions on the form of silver halide grains and the grain size distribution thereof The silver halide emulsion layers in this invention may contain, in addition to photosensitive silver halide, one or more chemical sensitizers, spectral sensitizers, antifoggants, hydrophilic colloids (in particular, gelatin), gelatin hardening agents, improving agents of photographic properties of film, such as surface active agents, etc., tackifiers, etc. These additives are described in *Research Disclosure* Vol. 176, 17643, (December, 1978), and Japanese Patent Applications (OPI) 108130/77, 114328/77, 121321/77, 3217/78, and 44025/78.

A surface protective layer is a layer containing a hydrophilic colloid as earlier exemplified such as gelatin as the binder and having a thickness of from 0.3 μm to 3 μm, and particularly from 0.5 μm to 1.5 μm. The protective layer generally contains a matting agent such as fine particules of polymethyl methacrylate, colloidal silica, and, if necessary, a tackifier such as potassium polystyrene sulfonate, a gelatin hardening agent, a surface active agent, a lubricant, a ultraviolet absorbent, etc. The matting agent is preferably used in an amount of from 10 to 400 mg/m$^2$.

A back layer is a layer containing a hydrophilic colloid as earlier examplified such as gelatin as the binder and may be a single layer or a multilayer including an interlayer and a protective layer.

The thickness of the back layer is from 0.1 μm to 10 μm and, if necessary, the back layer may contain a gelatin hardening agent, a surface active agent, a matting agent, colloidal silica, a lubricant, an ultraviolet absorbent, a dye, a tackifier, etc., as is used in the silver halide emulsion layer and the surface protective layer.

For example, polyalkylene oxides having molecular weight of at least 600 as described in Japanese Patent Publication 9412/83 are preferably used as a surface active agent in this invention.

The present invention can be applied to various photographic materials having hydrophilic colloid layers, and typical photographic materials using silver halide as photosensitive component include photographic light-sensitive materials for printing, X-ray light-sensitive materials, general negative photographic light-sensitive materials, general reversal photographic light-sensitive materials, general positive photographic light-sensitive materials, direct positive photographic light-sensitive materials, etc. The effect of this invention is particularly remarkable in photographic light-sensitive material for printing.

In other embodiment of this invention, it is preferred to wind the photographic light-sensitivematerial of this invention produced around a core so that the temperature of the emulsionlayer surface becomes from 40° C. to 50° C. for obtaining a photographic light-sensitive material having uniform and sufficient dimensional stability along the whole length of the long light-sensitive material with good reproducibility.

The winding conditions for the photographic light-sensitive material of this invention according to the preferred embodiment of this invention are now explained.

In general, a photographic light-sensitive material is produced by coating one or more photographic coating compositions on a continuously travelling support by a coating system such as dip coating system, air knife coating system, extrusion coating system, curtain coating system, etc., and after drying, winding the coated material around a core. At drying, the layers directly after coating are coagulated in a cooling zone utilizing the sol to gel change phenomenon of a hydrophilic colloid such as gelatin and thereafter the temperature of the system is gradually raised to finish drying with a constant drying period where the evaporating amount of the solvent per unit time, that is, the evaporation rate of solvent, is constant and then the evaporation ratio is descreased where the evaporation rate of solvent is gradually lowered until almost no evaporation of solvent occurs (reaching an equilibrium water content for the coated layer under the environmental temperature and humidity conditions). The drying zone is usually set so that a temperature of from about 40° C. to about 60° C. is the primary drying temperature.

The photographic light-sensitive material from the drying zone is, as the case may be subjected to humidity control and then sent to a winding rool, where the light-sensitive material is wound a round a core in roll from. The winding room is usually kept at a constant room temperature (from 15° C. to 25° C.) and normal humidity (a relative humidity of from 50% to 65%) and the photographic light-sensitive material sent to the room is wound around the core at the same temperature.

In a specific embodiment of this invention, the temperature of the photographic light-sensitive. material at winding is slightly evaluated. That is, when the photographic light-sensitive material having the layer(s) containing the vinylidene chloride copolymer according to this invention is wound a round a core as a roll in a length of several thousands meters in a heated state, the photographic light-sensitive material in roll form is kept in the warmed state for a considerable period of time, whereby the water proofing property of the layer containing the vinylidene chloride copolymer is increased and there are neither and efficiency of water proofing property based on the fact that a long time period is required for heat to reach the inside of the roll of the light-sensitive material in the case of heating the roll of light-sensitive material nor the defect that the water proofing property differs in different positions in the roll. Thus, a photographic light-sensitive material having uniform and good dimensional stability along the whole length of the long photographic light-sensitive material is obtained.

The outermost side of the roll of the photographic material thus heated is liable to radiate heat, but since heat is diffused from the inside of the roll, the roll can be kept warm for a relatively long period of time. In particular, if the roll of the photographic material is packed in a heat insulating packaging material immediately after winding, the outermost side of the roll can be kept sufficiently warm.

For keeping the photographic light-sensitive material thus rolled and heated in a warm state at withdrawing the core from the roll, the temperature of the drying zone and the winding room can be kept at from 40° C. to 50° C. so that the temperature of the photographic material after drying is not reduced or a heating means may be equipped on the roll winder. As the heating means, a hot air blast, the application of high frequency or ultrasonic waves, or contact with a hot roller may be employed for keeping the inside temperature of the roll photographic material at a temperature of from about 40° C. to about 50° C. In this case, it is unnecessary that the temperature of the coated layers of the photographic light-sensitive material at winding be at a temperature from about 40° C. to about 50° C., but when the temperature of the coated layers is lower than the aforesaid temperature, the temperature of the roll of the photographic material after winding can be kept at a temperature of from about 40° C. to about 50° C. by winding the photographic material in hot air. The heating means may be singular or plural and also the photographic light-sensitive material may be heated from the emulsion layer side, the opposite side thereto, or both sides thereof. The mount of heat applied to the photographic material is selected according to the coating speed of the photographic material, etc.

In another embodiment of this invention, the aforesaid objects of this invention can be effectively attained by close packgaging the silver halide photographic light-sensitive material having the layers containing the vinylidene chloride copolymer so that the inside of the package is at from 18° C. to 30° C. in temperature and from 40% to 55% in relative humidity.

The term "close packaging" in this invention means that the silver halide photographic material is placed in a package having humidity resistance and the package is closed by a heat seal, etc., so that the temperature and the relative humidity in the package are at 18 to 30° C. ad 40 to 55% relative humidity, respectively, to keep the photographic material at equilibrium in the aforesaid temperature and humidity ranges. The close packaging is preferably carried out for at least 8 hours. If the temperature and the humidity in the package after closing the package of the photosensitive material are from 18° C. to 30° C. and from 40% to 55%, respectively, there are no particular restrictions on the temperature and the humidity of the coating and drying zones, the widing room, and the packaging room. In other words, the silver halide photographic material may be produced at a temperature and humidity used inordinary practice if the aforesaid conditions in the inside of the package are maintained.

Furthermore, it is particularly preferred that after finishing the manufacture of the photographic material, the photographic material is subjected to seasoning at 18 to 30° C. in temperature and from 40 to 55% in relative humidity and then the photographic material is heat sealed in a package under the same conditions as above.

The package for use in this invention may have any form if it can close package silver halide photographic materials, and there are packages of various forms according the the use and form of the photographic light-sensitive materials being packaged. A package made by heat sealing is usually preferred, the package is preferably composed of a polyethylene film (usually containing carbon black, etc., for imparting a light-shading property to the polyethylene film and materials for providing a smooth surface thereto; said mateiral should have no harmful influence on the light-sensitive materials) which has low moisture permeability, and packaging materials as disclosed in Japanese Patent Applications (OPI) 6754/82, 132555/83, 189936/86, etc., are preferably used.

The aforesaid embodiment of this invention is particuarly effective for very high-contrast photographic light-sensitive mateirals containing hydrazine derivatives. The very high contrast photographic light-sensitive materials containing hydrazine derivatives and a process of forming images using such light-sensitive materials are described in U.S. Pat. Nos. 4,224,401, 4,168,977, 4,166,742, 4,421,164, and 4,272,606, Japanese Patent Applications (OPI) 83028/85, 218642/85, 258537/85, 223738/86, etc., incorporated by reference.

There are no particular restrictions on the light-exposure method and processing conditions for hte photographic light-sensitive materials of this invention and they are described, for example, in Japanese Patent Applications (OPI) 108130/77, 114328/77, 121321/77, and the above described *Research Disclosures,* incorporated by reference.

Also, in the case of processing the photographic light-sensitive materials, amines may be added to the developer for increasing the developing speed and shorten the processing time as described in U.S. Pat. No. 4,269,929, incorporated by reference.

According to this invention, a silver halide photographic material excellent in dimensional stability with changes in environmental conditions and also excellent in dimensional stability upon processing is obtained by coating both surfaces of a polyester support with a layer of a vinylidene copolymer having a thickness of at least 0.3 μm, the support having on the copolymer layer at least one hydrophilic colloid layer containing a polymer latex.

The invention is now further described more practically by the following Exampels.

EXAMPLE 1

Four rod electrodeseach having a length of 40 cm and a semicircular cross section (3 cm in diameter) were fixed on an insulating plate in parallel with the surface thereof at an interval of 10 cm from each other. The electrode plate was fixed in a vacuum tank and a biaxially oriented polyethylene terephthalate film 100 μm thick and 30 cm wide was travelled along two rollers disposed above the electrode plate with a distance of 15 cm at a speed of 20 mm/min. Directly before the passage of the film above the electrode plate, a heated roll kept at 120° C. and having a diameter of 50 cm., the heated roll being equipped with a temperature controller, was disposed so that the film was contacted with the surface of the roll at ¾ of the whole outer surface thereof. A glow discharge was generated applying an electric potential of 2,000 volts to each electrode while maintaining the inside of the vacuum tank at 0.1 Torr. In this case the electric current passed through the electrode was 0.5 amperes. Also, the polyethylene terephthalate film was subjected to a glow discharge treatment at 0.125 kv.amp.min./$m^2$.

On the polyethylene terephthalate (after PET) film thus treated there was coated an aqueous dispersion of a copolymer of vinylidene chloride, methyl acrylate, and acrylic acid at 90 : 5 : 5 by weight% on one surface or both surfaces thereof at various thicknesses as shown in table 1 below to provide sampels. The thickness of coating of the layer shown in Table 1 in the case of coating both surface of the support means the thickness of coating of the layer coated on each surface of the support.

Furthermore, a coating composition for a subbing layer having formula (1) described below was coated on both surfaces thereof at an amount of 20 ml/$m^2$ and then a silver halide emulsion of formula (2) described below was coated on one surface thereof at a silver coverage of 4.5 g/$m^2$. Furthermore, a protective layer of formula (3) described below was coated onthe silver halide emulsion layer and a back layer having formula (4) described below was coated on the other side of the support at a thickness of 3.5 μm. Thus, samples 1 to 13 were prepared.

Formula (1): Formula for Subbing Layer:

| | |
|---|---|
| Gelatin | 1.0 weight parts |
| Reaction product of polyamide composed of diethylenetriamine and adipic acid and | 0.07 weight parts |

-continued

| | |
|---|---|
| epichlorohydrin | |
| Saponin | 0.01 weight parts |
| Water to make | 100 weight parts |

Formula (2): Formula for Silver Halide Emulsion:

| | |
|---|---|
| Gelatin | 4 g/m$^2$ |
| Silver Chloroiodobromide Emulsion (Cl: 80 mol %, Br: 19.5 mol %, I: 0.5 mol %) | |
| Chloroauric Acid | 0.1 mg/m$^2$ |
| Polymer Latex E-1* | 1.5 g/m$^2$ |
| Sensitizing Dye: 3-Allyl-5-[2-(1-ethyl)-4-methyl-2-tetrazoline-5-iridene-ethylidene]rhodanine | 6 mg/m$^2$ |
| Stabilizer: 4-Hydroxy-6-methyl-1,3,3a,7-tetraazaindene | 30 mg/m$^2$ |
| Polyoxyethylene Compound | 12 mg/m$^2$ |

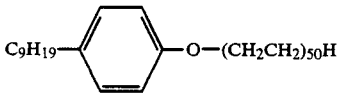

| | |
|---|---|
| Surface Active Agent: Sodium p-Dodecyl-benzenesulfonate | 40 mg/m$^2$ |
| Gelatin Hardening Agent: | 105 mg/m$^2$ |

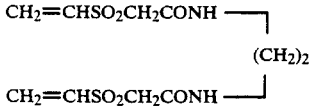

(* Polymer Latex E-1 has an average diameter of 80 nm and about 300,000 of molecular weight.)

Formula (3): Formula for Protective Layer:

| | |
|---|---|
| Gelatin | 1 g/m$^2$ |
| Matting Agent: Silica Particles having a mean particle size of 4 μm | 50 mg/m$^2$ |
| Surface Active Agent: Sodium p-Dodecyl-benzenesulfonate | 30 mg/m$^2$ |
| Gelatin Hardening Agent: | 10 mg/m$^2$ |

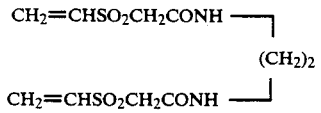

Formula (4): Formula for Back Layer:

| | |
|---|---|
| Gelatin | 4 g/m$^2$ |
| Matting Agent: Polymethyl Methacrylate having a mean particle size of 3.0 to 4.0 μm | |
| Polymer Latex E-1 | 2 g/m$^2$ |
| Surface Active Agent: Sodium p-Dodecylbenzenesulfonate | 40 mg/m$^2$ |
| Gelatin Hardening Agent: | 110 mg/m$^2$ |

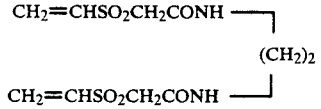

| | |
|---|---|
| Dye: 1:1:1 mixture (by weight) of Dye [I], Dye [II], and Dye [III] | 0.3 g/m$^2$ |

-continued

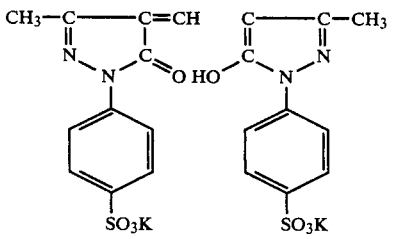

Dye (I)

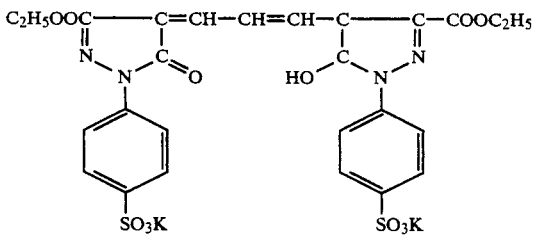

Dye (II)

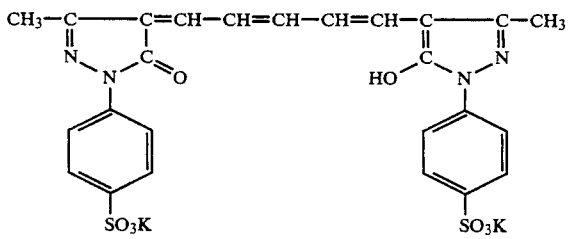

Dye (III)

The dimensional change of each of Sampels 1 to 14 thus prepared upon processing was then measured in the following manner. Two holes 8 mm in diameter were formed in each sample at an interval of 200 mm along the length of each sample and after allowing the samples to stand in a room kept at 25° C. and 30% RH, the interval between the two holes was accurately measured using a pin gauge with a precision of 1/1000 mm. The length of the interval was defined as X mm. Then, the samples were subjected to development, fixing, washing and drying using an automatic processor. The length of the interval between the holes 5 minute after the processing was defined as Y mm. The dimensional change ratio (5). upon processing was evaluated by the value $$\frac{Y - X}{200} \times 100$$

The processing was performed using an automatic processor FR-660 (trade name, made by Fuji Photo Film Co.), developer HS-5, and fixing solution LF-308 (both trade name, made by Fuji Photo Film Co.) under processing conditions of 32° C. and 60 seconds. The drying temperature in this case was 45° C.

The results thus obtained are shown Table 1 below.

TABLE 1

| Sample No. | Coating of Vinylidene Chloride Copolymer | Thickness of Coating | Dimensional charge |
|---|---|---|---|
| 1. | — | 0μ | 0.023% |
| 2. | One side | 0.1 | 0.023 |
| 3. | " | 0.3 | 0.023 |
| 4. | " | 0.5 | 0.022 |
| 5. | " | 1.0 | 0.022 |

TABLE 1-continued

| Sample No. | Coating of Vinylidene Chloride Copolymer | Thickness of Coating | Dimensional charge |
|---|---|---|---|
| 6. | " | 3.0 | 0.022 |
| 7. | " | 10.0 | 0.021 |
| 8. | Both side | 0.1 | 0.021 |
| 9. (Invention) | " | 0.3 | 0.010 |
| 10. (Invention) | " | 0.5 | 0.008 |
| 11. (Invention) | " | 1.0 | 0.007 |
| 12. (Invention) | " | 3.0 | 0.007 |
| 13. (Invention) | " | 10.0 | 0.006 |

As is clear from the results shown in Table 1 above, in the case of not coating both surfaces of the support with the vinylydene chloride copolymer, the effect of reducing the dimensional change with processing was not obtained. Also, it can be seen that as the thickness of the coating layer becomes thicker, the dimensional change becomes less and the effect is remarkable when the thickness is greater thank 0.3 μm.

EXAMPLE 2

On the support as for Samples 1 or 11 in Example 1 there was coated a silver halide emulsion of formula (2) in Example 1 while changing only the amounts of the polymer latex and gelatin at a silver coverage of 4.5 g/m$^2$ as in Example 1. Thereafter, a protective layer of formula (3) in Example 1 was formed thereon and then a back layer of formula (4) in Example 1 was coated thereon while changing only the amounts of the polymer latex and gelatin. Thus, samples 15 to 24 were obtained.

The amounts of the polymer latex and gelatin in each silver halide emulsion layer and backing layer are shown in Table 2 below.

TABLE 2

| Sample No. | Support | Emulsion: Amount of Polymer Latex | Emulsion: Amount of Gelatin | Backing Layer: Amount of Polymer Latex | Backing Layer: Amount of Gelatin |
|---|---|---|---|---|---|
| 15 | Support of Sample 1 | 0 g/m$^2$ | 3.5 g/m$^2$ | 0 g/m$^2$ | 4.5 g/m$^2$ |
| 16 | " | 0.7 | " | 0.9 | " |
| 17 | " | 1.4 | " | 1.8 | " |
| 18 | " | 2.1 | " | 2.7 | " |
| 19 | " | 3.1 | " | 4.1 | " |
| 20 | Support of Sample 11 | 0 | " | 0 | " |
| 21 ( ) | " | 0.7 | " | 0.9 | " |
| 22 ( ) | " | 1.4 | " | 1.8 | " |
| 23 ( ) | " | 2.1 | " | 2.7 | " |
| 24 ( ) | " | 3.1 | " | 1.1 | " |

For testing the dimensional change of samples 15 to 24 thus prepared with changes in humidity, the samples before processing and the samples processed as in Example 1 were allowed to stand for 6 hours in a room kept at 25° C. and 30% RH. Then, 2 holes 8 mm in diameter were formed at an interval of 200 mm, the interval (mm unit) between the two holes was accurately measured using a pin gauge (accuracy of 1/1000). After allowing the samples to stand for 6 hours in a room kept at 25° C. and 80% RH, the interval between the holes was measured in the same way as above for each sample. The humidity expansion coefficient was then obtained by the following equation:

$$\text{Humidity Expansion Coefficient} = \frac{(A) - (B)}{200 \times 50}$$

(A): The length of the interval at 80% RH (B): The length of the interval at 30% RH Furthermore, the dimensional change with processing was measured for each sample in the same manner as in Example 1.

The results obtained are shown in Table 3 below.

The film strength of the emulsion layer and the backing layer represents the load sufficient to destruct or tear the layer by scratching with a sapphire needle 0.8 mm in diameter after immersing the sample in water at 25° C. for 5 minutes.

From the results in Table 3, it can be seen that the dimensional change of a sample containing the polymer latex in the hydrophilic colloid layer before and after processing was not so good but the dimensional change was greatly reduced according to this invention.

Also, it can be seen that by the addition of a polymer latex which gave a very small effect of reducing the film strength of the photographic material in processing solutions, the dimensional stability is also improved.

TABLE 3

| Sample No. | Moisture Absorption Expansion Coeff. Before Processing (mm/mm/% RH) | Moisture Absorption Expansion Coeff. After Processing (mm/mm/% RH) | Dimensional Change with Processing (%) | Film Strength of Emulsion Layer (%) | Film Strength of Backing Layer (%) |
|---|---|---|---|---|---|
| 15 | $1.82 \times 10^{-5}$ | $1.71 \times 10^{-5}$ | 0.030 | 153 | 165 |
| 16 | $1.61 \times 10^{-5}$ | $1.50 \times 10^{-5}$ | 0.025 | 130 | 147 |
| 17 | $1.49 \times 10^{-5}$ | $1.40 \times 10^{-5}$ | 0.022 | 120 | 138 |
| 18 | $1.37 \times 10^{-5}$ | $1.28 \times 10^{-5}$ | 0.020 | 109 | 125 |
| 19 | $1.30 \times 10^{-5}$ | $1.21 \times 10^{-5}$ | 0.019 | 65 | 80 |
| 20 | $1.59 \times 10^{-5}$ | $1.49 \times 10^{-5}$ | 0.015 | 154 | 164 |
| 21 (Invention) | $1.47 \times 10^{-5}$ | $1.38 \times 10^{-5}$ | 0.009 | 129 | 148 |
| 22 (Invention) | $1.30 \times 10^{-5}$ | $1.20 \times 10^{-5}$ | 0.007 | 119 | 135 |
| 23 (Invention) | $1.25 \times 10^{-5}$ | $1.16 \times 10^{-5}$ | 0.005 | 110 | 123 |
| 24 (Invention) | $1.21 \times 10^{-5}$ | $1.10 \times 10^{-5}$ | 0.005 | 68 | 83 |

EXAMPLE 3

By coating both surfaces of a biaxially oriented polyethylene terephthlate film 100 μm thick subjected to a glow discharge treatment as in Example 1 with an aqueous dispersion of each of the polymers shown in Table 4 below, various coated supports were prepared. One each support there was coated a subbing layer of formula (1) in Example 1 at a coverage of 20 ml/m$^2$ and further a silver halide emulsion layer of formula (2) and a protective layer of formula (3) in Example 1 were coated on the subbing layer. Also, a backing layer of formula (4) in Example 1 was coated on the support on the side opposite the emulsion side. Thus, samples 25 to 32 were prepared.

the dimensional change of each sample upon processing was measured as in Example 1 and the results obtained are shown in Table 4 below. The adhesive property shown in the table is that between the support and the emulsion layer and also the backing layer. The tests methods are as follows.

1. Test Method for Adhesive Property of Dry Film:

A total of 7 lines were cut to a depth reaching the support surface were formed crosswise in the emulsion layer at an interval of 5 mm each to form 36 squares. Adhesive tape (Nitto Tape, made by Nitto Electric Industrial Co., Ltd.) was adhered to the surface of the emulsion layer and then peeled off in the direction at an angle of 180° C. In this method, the case that the unpeeled portion is more than 90% is evaluated as class A, the case that the unpeeled portion is 60% to 90% is evaluated as class B, and the case that the unpeeled portion is less than 60% is evaluated as class C. An adhesive strength sufficient for practical use in a photographic light-sensitive material is class A of the aforesaid three classes.

2 Test Method for Adhesive Property of Wet Film:

In each step of development, fixing, and washing, a scratch in X shape was formed in the emulsion layer using a stencil pen in the processing solutions, the emulsion layer was strongly rubbed with a finger tip five times, and the maximum peeled width along the X shape was used as a measure for the evaluation of the adhesive property.

The case that the emulsion layer is not peeled off over the scratch is defined as Grade A, the case that the maximum peeled width is within 5 mm is defined as Grade B, and other cases are defined as Grade C, A wet adhesive strength sufficient for practical use in a photographic light-sensitive material is above Grade B, and preferably is Grade A.

TABLE 4

| Test No. | Coating Polymer (wt. ratio) change | Dimensional | Adhesive property |
|---|---|---|---|
| 25 | Methyl Acylate | 0.022% | B |
| 26 | Vinyl Acetate/Methyl Acrylate/-Itaconic Acid (90/10/10) | 0.022% | B |
| 27 | Synthesis Compound - 1 in Japanese Patent Application (OPI) No. 114120/76 | 0.022% | A |
| 28 | Vinylidene Chloride/Methyl Acrylate/Acrylic Acid (40/50/10) | 0.021 | A |
| 29 (Invention) | Vinylidene Chloride/Methyl Acrylate/Acrylic Acid (80/15/5) | 0.008 | A |
| 30 (Invention) | Vinylidene Chloride/Methyl Acrylate/Hydroxyethyl Acrylate (90/5/5) | 0.007 | A |
| 31 (Invention) | Vinylidene Chloride/Ethyl Acrylate/Acrylic Acid (92/5/3) | 0.007 | A |
| 32 (Invention) | Vinylidene Chloride/Acrylonitrile/Acrylic Acid (95/3/2) | 0.006 | A |

As is clear from the results shown in Table 4, it can be seen that samples 29 to 32 of this invention have good adhesives property between the support and the emulsion layer or the backing layer and have greatly improved dimensional stability.

EXAMPLE 4

To a silver iodobromide emulsion (mean grain size 0.25μm) containing 1 mol% silver iodide were added 5.5'-dichloro-9-ethyl-3,3'-bis(3-sulfopropyl) oxacarbocyanine sodium salt as a sensitizing dye, 4-hydroxy-6-methyl-1, 3, 3*a*, 7- tetraazaindene as a stabilizer polyethyleneglycol, and hydrazine derivative (I - 1) as a contrast increasing agent in an amount of $4.0\times10^{-3}$ mol per mol of silver Furthermore, polymer latex E - 1 was added tot he emulsion in the amount shown in Table 5 below. In this case, as a gelatin hardening agent, the compound used in Example 1 was used. The used amount of the stabilizer and the sensitizing dye are these which are generally used in the emulsion.

The silver halide emulsion thus obtained was coated on the support as Sample 1 or 11 in Example 1 at a silver coverage of 4 g/m$^2$ and a gelatin coverage of 3 g/m$^2$ and, furthermore, a protective layer of formula (3) in Example 1 was coated on the emulsion layer. Then, a backing layer as in Example 1 was coated on the support on the surface opposite to the emulsion side. Thus, Sample 33 to 40 were prepared.

Using each sample thus prepared, the dimensional change upon processing was measured as in Example 1. In this case, the processing was performed using an automatic processor FG-660F., developer GR-Dl, and fixing solution GR-Fl (each, trade name, made by Fuji Photo Film Co.) for 30 seconds at 34° C.

The results obtained are shown in Table 5 below.

TABLE-5

| Sample No. | Support | Amount of Polymer Latex | Dimensional change | Photographic Property: Relative[91] Sensitivity | Photographic Property: $\gamma$[(2)] |
|---|---|---|---|---|---|
| 33 | Support of Sample-1 | 0 g/m$^2$ | 0.027% | 100 | 17 |
| 34 | " | 1.2 | 0.021 | 98 | 17 |
| 35 | " | 1.8 | 0.019 | 95 | 16 |
| 36 | " | 2.7 | 0.017 | 83 | 10 |
| 37 | Support of Sample-11 | 0 | 0.014 | 100 | 17 |
| 38(Invention) | " | 1.2 | 0.006 | 98 | 17 |
| 39(Invention) | " | 1.8 | 0.005 | 95 | 16 |
| 40(Invention) | " | 2.7 | 0.005 | 83 | 10 |

[(1)]The relative sensitivity is a relative value of the reciprocal of the exposure amount giving a density of 1.5 at 34° C. and for 30 seconds, with the value of sample −33 being defined as 100.

[(2)]

$$\gamma = \frac{3.0 - 0.3}{-(\log A - \log B)}$$

A: The exposure amount giving a density of 0.3

B: The exposure amount giving a density of 3.0

As is clear from the results of Table 5, when a large amount of polymer latex is used for reducing the dimensional change .of the photographic material, the contrast increasing action is reduced but, according to this invention, the dimensional stability is greatly improved by using the polymer latex in an amount which has no disadvantageous influences on photographic characteristics.

EXAMPLE 5

A polyethylene terephthalate film 100 μm thick subjected to a glow discharge treatment as in Example 1 was coated on both surfaces thereof with an aqueous dispersion of a copolymer of vinylidene chloride, methyl methacrylate, and acrylonitrile (90 : 8 : 2 by weight percent) having 500,000 of molecular weight at a dry thickness of 1 μm to provide a support. On the support these was coated a subbing layer of formula (1) as in Example 1 at a coverage of 20 ml/m$^2$. To a silver chloride emulsion (mean grain size 0.2 μm) containing $5\times10^{-6}$ mol rhodium per mol of silver were added 4-hydroxy-6-methyl-3,3*a*,7-tetraazaindene in an amount of $5\times10^{-3}$ mol per mol of silver, 1-phenyul-5-mercaptotetrazole in an amount of $4\times10^{-3}$ mol per mol of silver and hydrazine derivative (I-1) as a contrast increasing agent in an amount of $4\times10^{-3}$ mol per mol of silver. Furthermore, each of the compounds shown in Table 6 below was added to the emulsion in an amount of 1.4 g/m². Also, a gelatin hardening agent as used in Example 1 was used. The emulsion was coated on the aforesaid support at a silver coverage of 3.8 g/m² and a gelatin coverage of 3.0 g/m² and further a protective layer of formula (3) in Example 1 was coated thereon. Also, a backing layer of formula (4) in Example 1 was coated on the surface thereof opposite the emulsion side. Thus, samples 41 to 44 were prepared.

As comparison samples, samples 45 to 48 were prepared by coating the emulsion layer, protective layer and backing layer on the support of Sample 1 in Example 1 in the same manner as described above.

For each of the samples thus prepared, the dimensional change upon processing was measured as in Example 1. In this case, the development processing was performed at 38° C. for 20 seconds as in Example 4. The results obtained are shown in Table 6 below.

TABLE 6

| Sample No. | Polymer Latex | Dimensional Change |
|---|---|---|
| 41 (Invention) | E-1 | 0.005% |
| 42 (Invention) | E-5 | 0.005% |
| 43 (Invention) | E-9 | 0.005% |
| 44 (Invention) | E-38 | 0.005% |
| 45 (Comparison) | E-1 | 0.018% |
| 46 (Comparison) | E-5 | 0.019% |
| 47 (Comparison) | E-9 | 0.018% |
| 45 (Comparison) | E-38 | 0.020% |

As is clear from the results shown in Table 6, samples 41 to 44 of this invention are excellent in dimensional stability with processing as compared with the comparison samples.

EXAMPLE 6

By following the procedures as the case of preparing samples 41 and 45 in Example 5 except that the thickness of polyethylene terephthalate film as the support was changed as shown in Table 7, samples 49 to 56 were prepared. For each of the samples, the dimensional change upon processing was measured in Example 5. The results thus obtained are shown in Table 7 below.

TABLE 7

| Sample No. | Thickness of Polyethylene Terephthalate | Dimensional Change |
|---|---|---|
| 49 (Invention) | 150 μm in Sample 41 | 0.004% |
| 50 (Invention) | 175 μm in Sample 41 | 0.003% |
| 51 (Invention) | 200 μm in Sample 41 | 0.002% |
| 52 (Invention) | 225 μm in Sample 45 | 0.002% |
| 53 (Comparison) | 150 μm in Sample 45 | 0.011% |
| 54 (Comparison) | 175 μm in Sample 45 | 0.010% |
| 55 (Comparison) | 200 μm in Sample 45 | 0.008% |
| 56 (Comparison) | 225 μm in Sample 45 | 0.007% |

As is clear from the results shown in Table 7, samples 49 to 52 of this invention are excellent in dimensional stability upon processing as compared to the comparison examples.

EXAMPLE 7

To a silver chlorobromide emulsion (Br 1 mol%, mean grain size 0.2 μm) containing $1\times10^{-5}$ mol rhodium per mol of silver, which was not chemically ripened. There was added 4-hydroxy-6-methyl-1,3,3*a*,7-tetraazaindene as a stabilizer. To the emulsion was added a tetrazolium salt having the following formula in an amount of $5\times10^{-3}$ mol per mol of silver.

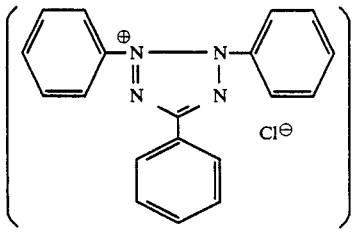

The silver halide emulsion was split into two portions and polymer latex E-1 or E-9 was added to each emulsion, respectively, at 1.4 g/m². Also, the gelatin hardening agent as in Example 1 was used for each emulsion.

Each of the emulsions was coated on a support as used for sample 11 in Example 1 at a silver coverage of 3.9 g/m² and a gelatin coverage of 3.1 g/m² and further a protective layer of formula (3) in Example 1 was coated on the emulsion layer. Also, a backing layer of formula (4) in Example 1 was formed on the surface opposite the emulsion side thus, samples 57 to 60 were prepared.

The dimensional change upon processing of each samples was measured in the same manner as in Example 1 using developer A having the following composition under the conditions of 28° C and 30 seconds.

| Developer A | |
|---|---|
| Ethylenediaminetetraacetic Acid Di-sodium Salt (dihydrate) | 0.75 g |
| Anhydrous Potassium Sulfite | 51.7 g |
| Anhydrous Potassium Carbonate | 60.4 g |
| Hydroquinone | 15.1 g |
| 1-Phenyl-3-pyrazolidone | 0.51 g |
| Sodium Bromide | 2.2 g |
| 5-Methylbenztriazole | 0.124 g |
| 1-phenyl-5-mercaptotetrazole | 0.018 g |
| 5-Nitroindazole | 0.106 g |
| Diethylene Glycol | 98 g |
| Water to make | 1 liter (pH = 10.5) |

The results obtained are shown in Table 8.

TABLE 8

| Sample No. | Support | Polymer Latex | Dimensional Change |
|---|---|---|---|
| 57 (Comparison) | Sample 1 | E-1 | 0.019% |
| 58 (Comparison) | Sample 1 | E-9 | 0.019% |
| 59 (Invention) | Sample 11 | E-1 | 0.005% |
| 60 (Invention) | Sample 11 | E-9 | 0.005% |

As is clear from the results shown in Table 8, samples 59 and 60 of this invention are excellent in dimensional stability upon processing as compared with the comparison samples.

EXAMPLE 8

To a silver chlorobromide emulsion (Br 1 mol%, mean grain size 0.22 μm) containing $1\times10^{-4}$ mol rhodium per mol of silver, which was not chemically ripened, was added 4-hydroxy-6-methyl-1,3,3*a*,7-tetraazaindene as a stabilizer. The emulsion was split into two portions and polymer latex E-1 or E-9 was added to each emulsion, respectively, at 1.5 g/m². The gelatin hardening agent as used in Example 1 was used for each emulsion. The emulsion was coated on a support as used for sample 1 or 11 in Example 1 at a silver coverage of 3.8 g/m² and a gelatin coverage of 3.2 g/m². Further, protective layer and a backing layer were formed as in Example 7. thus, samples 61 to 64 were prepared.

The dimensional change upon processing for each sample thus prepared was measured as in Example 5. The results thus obtained are shown in Table 9 below.

TABLE 9

| Sample No. | Support | Polymer Latex | Dimensional Change |
|---|---|---|---|
| 61 (Comparison) | Sample 1 | E-1 | 0.018% |
| 62 (Comparison) | Sample 1 | E-9 | 0.018% |
| 63 (Invention) | Sample 11 | E-1 | 0.005% |
| 64 (Invention) | Sample 11 | E-9 | 0.005% |

As is clear from the results shown in Table 9, Samples 63 and 64 of this invention are excellent in dimensional stability as compared with the comparison samples.

EXAMPLE 9

Following the same procedure as Example 1 while changing only the polymer latex in Example 8 to each of polymer latexes E-2, E-7, E-10, E-12, E-15, E-17. E-39 and E-40, the dimensional change upon processing was measured and the results obtained were almost the same as those in Example 8.

EXAMPLE 10

Four rod electrodes each having a length of 2.5 cm and a semicircular cross section of 3 cm in diameter were fixed on an insulating plate in parallel with the surface thereof at an interval of 10 cm from each other. The electrode plate was fixed in a vacuum tank and a biaxially oriented polyethylene terephthalate film 100 μm thick and 2.4 cm in width was travelled along two rollers disposed above the electrode plate at a distance of 15 cm at a speed of 100 m/min. Directly before the passage of the film above the electrode plate, a heated roll kept at 120° C., and having a diameter of 50 cm equipped with a temperature controller was disposed so that the film was contacted with the surface of the roll at ¾ of the sole outer surface thereof. A glow discharge was generated by applying an electrical potential of 2,000 volts to each electrode while maintaining the inside of a vacuum tank at 0.1 Torr. In this case, the electric current passed through the electrode was 4.8 amperes. Also, the polyethylene terephthalate film was subjected to a corona discharge treatment at 0.16 kv.amp.min./m².

On the polyethylene terephthalate film thus treated was coated an aqueous dispersion containing 15% by weight of a copolymer of vinylidene chloride, methylacrylate and acrylic acid at 90:5:5 (weight%) on one surface or both surfaces thereof at various thicknesses as shown in Table 10 to provide samples 101 to 106.

Further, a coating composition for a subbing layer having formula (1) in Example 1 was coated on both surfaces thereof at an amount of 20 ml/m². Then, a silver halide emulsion of formula (2) as in Example 1 was formed on one surface of the support at a silver coverage of 4.5 g/m² and a protective layer of formula (4) in Example 1 was formed on the emulsion layer. A backing layer of formula (4) in Example 1 was further formed on the surface opposite the emulsion layer side at a thickness of 3.5 μm.

The aforesaid coated material from the drying zone was sent to a winding room, where the coated film was would around a core at a length of 2,500 meters. The web rolls were immediately heated to 40° C. for 16 hours in a heating room to yield Group A. Web rolls from the drying zone without being heated in the heating room were defined as Group B.

Then, for samples 101 to 106 of each group, the dimensional change upon processing was measured by the following method. That is, a 2 holes 8 mm in diameter were formed in each sample at an interval of 200 mm and after allowing the sample to stand in the room kept at 25° C. and 30% RH, the interval of the 2 holes was accurately measured with a pin gauge of preciseness of 1/1000 mm. The interval was defined as X mm. Then, each sample was developed, fixed, washed and dried using an automatic processor and then the interval of the 2 holes was measured. The interval was defined as Y mm. The dimensional change (%) with process was evaluated by the value of the following equation;

$$\frac{Y - X}{200} \times 100$$

In the field of the photography, a sample film showing a dimensional change of 0.01% or lower is said to be useful for practical purpose without any problems. The aforesaid processing was performed using an automatic processor FG-660, developer; HS-5, and fixing solution LF-308 (trade names, made by Fuji Photo Film Co., Ltd.) at 32° C. for 60 seconds. The drying temperature was 45° C. The results obtained are shown in Table 10 below.

TABLE 10

| Sample No. | Coating Thickness of Vinylidene Chloride Copolymer | Dimensional Change Group A | Dimensional Change Group B |
|---|---|---|---|
| | (Heating Room) | | |
| 101 | 0 μm | 0.023% | 0.023% |
| 102 | 0.1 μm | 0.021% | 0.022% |
| 103 | 0.3 μm | 0.010% | 0.018% |
| 104 | 0.5 μm | 0.008% | 0.015% |
| 105 | 1.0 μm | 0.007% | 0.012% |
| 106 | 3.0 μm | 0.007% | 0.012% |

As is clear from the results shown in Table 10, the samples of this invention, which was heated at 40° C. in the heating room after coating the silver halide emulsion layer on the polyester support coated with a layer of vinylidene copolymer oat a thickness of at least 0.3 μm and drying showed very good dimensional stability.

EXAMPLE 11

On the support as for sample 104 in Example 10 having a length of 2,500 meters. There were coated the silver halide emulsion layer, the protective layer and the backing layer as in sample 104. In this case, before winding the coated film, the following treatment was applied to the sample.

(a) Directly before winding, the coated film was passed through a pair of heating rollers (the outer surface temperature of the rollers was from 70° to 90° C.) so that the surface temperature of the coated layer became 40° C. and then wound round a core to give sample 111.

(b) The final drying zone was kept at a temperature of 45° C. so that the surface temperature of the coated layer became 40° C. and the coated film was wound round a core to provide sample 122.

Also, after winding each coated film per sample 111 or 112, each sample was packed in a heat-insulating packaging material to provide samples 113 and 114, respectively.

Samples 111, 112, 113, and 114 each were allowed to stand for 16 hours at normal temperature. Then, the dimensional change with processing of each sample was measured as in Example 10 and the results obtained are shown in Table 11 below together with the result of sample 104 in Example 10.

TABLE 11

| Sample No. | Dimensional Change |
|---|---|
| 104 | 0.008% |
| 111 | 0.009% |
| 112 | 0.009% |
| 113 | 0.008% |
| 114 | 0.008% |

From the results shown in Table 11 above, it can be seen that samples 111 to 114 according to this invention showed almost the same dimensional stability as sample 104 heated in the heating room after winding.

EXAMPLE 12

By following the same procedure as for sample 112 in Example 11, 4 rolls of coated samples were prepared. After winding each sample while keeping the surface temperature of the coated layer at 40° C., each sample was packed in a heat-insulating packaging material (polyethylene film containing carbon black)and allowed to stand at room temperature for 4 hours, 8 hours, 24 hours, or 48 hours to provide samples 121, 122, 123, and 124, respectively.

For each sample, the dimensional stability upon processing was measured according to the process disclosed in Example 1. The results obtained are shown in Table 12 below

TABLE 12

| Sample No. | Stored time | Dimensional Stability |
|---|---|---|
| 121 | 4 hours | 0.013% |
| 122 | 8 hours | 0.010% |
| 123 | 24 hours | 0.008% |
| 124 | 48 hours | 0.007% |
| 111 | 16 hours | 0.009% |

In addition, the results for sample 111 in Example 11 are also shown in the above table.

As is clear from the results shown in Table 12 above, the samples stored for 8 hours or more in the heated state (i.e., heat insulated state) show sufficient dimensional stability.

EXAMPLE 13

A biaxially oriented polyethylene terephthalate film 100 μm thick subjected to a glow discharge treatment as in Example 10 was coated on both surfaces therewith an aqueous dispersion of each of the polymers shown in Table 13 below at a dry thickness of 1 μm to provide supports. On the supports there was coated a subbing layer of formula (1) in Example 1 at a coverage of 20 ml/m$^2$ and, furthermore, a silver halide emulsion layer of formula (2) and a protective layer of formula (3) in Example 1 were formed on the subbing layer. Also, a backing layer of formula (4) was formed on the opposite surface to the emulsion layer. Thus, coated films of 2,500 meters in length were prepared. Each of the coated films was dried and wound round a core by method (a) in Example 11. Thereafter, each sample was allowed to stand for 16 hours at room temperature in the sate of being a packed in an insulating packaging material thus, samples 131 to 138 were obtained,.

For each sample thus prepared, the dimensional stability upon processing was measured as in Example 1 and the adhesive property test in the dry state and the wet state was measured in the same manner as described in Example 3. The results obtained are shown in Table 13.

TABLE 13

| Test No. | Coated Polymer (weight ratio) | Dimensional Stability | Adhesive Property Dry | Adhesive Property Wet |
|---|---|---|---|---|
| 131 | Methyl Acrylate | 0.022% | B | A |
| 132 | Vinyl Acetate/Methyl Acrylate/Itaconic Acid (90/10/10) | 0.022% | B | A |
| 133 | Compound in Synthesis Example 1 of Japanese Pat. Appln. (OPI) NO. 114120/76 | 0.022% | A | A |
| 134 | Vinylidene Chloride/Methyl Acrylate/Acrylic Acid (40/50/10) | 0.021% | A | A |
| 135 | Vinylidene Chloride/-Methyl Acrylate/acrylic Acid (80/15/5) | 0.009% | A | A |
| 136 | Vinylidene Chloride/-Methyl Methacrylate/-Acrylonitrile (90/8/2) | 0.007% | A | A |
| 137 | Vinylidene Chloride/-Ethyl Acrylate/Acrylic Acid (92/5/3) | 0.007% | A | A |
| 138 | Vinylidene Chloride/-Acrylonitrile/Acrylic Acid (95/3/2) | 0.006% | A | A |

Samples 131 to 134: Comparison samples
Samples 135 to 138: Samples of this invention As is clear from the results shown in Table 13, it can be seen that the samples 135 to 138 of this invention show good adhesive property between the support and the emulsion layer and backing layer and also very improved dimensional stability.

EXAMPLE 14

By following the same procedure as for sample 112 in Example 11, one roll of coated film 2,500 meters in length was prepared. After winding the coated film while keeping the surface temperature of the coated layer at 40° C., the roll was packed in an insulating packaging material and stored for 16 hours at room temperature. Thereafter, samples were cut from the coated sample at 100 meters, 500 meters, 1,000 meters, 1,500 meters, and 2,500 meters from the outer end of the film and the dimensional stability upon processing was measured for each sample. The dimensional stability was all 0.008% and no non-uniformity in dimensional stability at any position was observed.

EXAMPLE 15

Three rolls of coated films were prepared by coating the silver halide emulsion layer, protective layer and backing layer as in Example 10 on a support as for sample 104 in Example 10 having a length of 2,500 meters. Before winding each coated film, the coated film was subjected to the following treatment.

In this case, directly before winding, each coted film was passed through pair of heated rollers (the outside surface temperature of the rollers being from 70° C. to 90° C.) so that the surface temperature of the coated layer became 30° C., 50° C. or 60° C. (by changing the travelling speed of the coated film) and then the coated film was would a round a core. Thereafter, each web of the coated film was packed in a heat-insulating packaging material and allowed to stand for 16 hours at room temperature. Thus, samples 151, 152, and 153 were prepared.

Then, the photographic properties and the dimensional stability thereof upon processing were evaluated.

Processing of each sample was performed using an automatic processor FG-660, a developer HS-5, and a fixing solution LF-308 (trade names, made by Fuji Photo Film Co., Ltd) for 60 seconds at 32° C.

The results thus obtained are shown in Table 14 below.

TABLE 14

| Sample No. | Dimensional Stability | Photographic Property (Fog) |
|---|---|---|
| 151 | 0.012% | 0.03 |
| 152 | 0.008% | 0.04 |
| 153 | 0.008% | 0.10 |
| 113 | 0.008% | 0.03 |

In addition, sample 113 in Example 11 described above is show in the table.

As is clear from the results shown in the above table, if the temperature at winding is low, the dimensional stability is slightly insufficient, while if the temperature is high, the photographic property is reduced. The winding temperature is most suitably from 40° C. to 50° C.

EXAMPLE 16

On each of the polyester supports prepared by the method shown in Example 1, there were formed a silver halide emulsion layer, a protective layer and a backing layer having the formulae shown in Example 1 to provide samples.

Each sample was cut into a sheet 25 cm ×25 cm. After allowing each sheet to stand for 24 hours in an atmosphere of 25° C. and 39% RH, 25° C. and 40% RH, 25° C. and 55% RH, 25° C. and 65% RH, or 25° C. and 75% RH, the sheet was heated sealed in a moisture proof bag under the same atmosphere as above, and the sheet was allowed to stand for about 3 weeks in the sealed state to provide samples 1-1 to 5-5 shown in Table 15 below. In addition, as the moisture proof bag, the bag described in Example 1 of Japanese Patent Application (OPI) No. 189936/86 was used.

Then, for each of samples 1-1 to 5-5 the dimensional change upon processing was measured by the following method.

That is, two holes 8 mm in diameter were formed in each sample at an interval of 200 mm and after allowing the sample to stand for 2 hours in a room kept at 25° C. and 30% RHG, the interval of the two holes was accurately measured using a pin gauge having preciseness of 1/1000 mm. The length thus measured was defined as X mm. Then, the sample was developed, fixed, washed and dried using an automatic processor and, after 5 minutes, interval of the holes was measured again. The length was defined as Y mm. then, the dimensional change ratio (%) with processing was evaluated by the following value;

$$\frac{Y - X}{200} \times 100$$

A sample having a dimensional changing ratio of ±0.01% or lower provides no problems in practical use.

The processing was performed using an automatic processor FG-660, a developer HS-5, and fixing solution LF-308 (trade-names, made by Fuji Photo Film Co., Ltd.) for 60 seconds at 32° C. In this case, the drying temperature was 45° C. The results obtained are shown in Table 15 below.

TABLE 15

| Sample No. | Thickness of Layer of Vinylidene Chloride Copolymer | Heat sealed by closing Temperature | Dimensional Change | Photographic Property Relative Temperature(1) | Photographic Property $\tau$(2) |
|---|---|---|---|---|---|
| 1-1 | 0 μ | 25° C. 30% RH | 0.013% | 92 | 10 |
| 1-2 | 0.1 | | 0.011 | " | " |
| 1-3 | 0.3 | | 0.008 | " | " |
| 1-4 | 0.5 | | 0.007 | " | " |
| 1-5 | 3.0 | | 0.006 | " | " |
| 2-1 | 0 μ | 25° C. 40% RH | 0.013% | 97 | 11 |
| 2-2 | 0.1 | | 0.011 | " | " |
| 2-3 | 0.3 | | 0.009 | " | " |
| 2-4 | 0.5 | | 0.007 | " | " |
| 2-5 | 3.0 | | 0.007 | " | " |
| 3-1 | 0 μ | 25° C. 55% RH | 0.023% | 97 | 12 |
| 3-2 | 0.1 | | 0.021 | " | " |
| 3-3 | 0.3 | | 0.010 | " | " |
| 3-4 | 0.5 | | 0.008 | " | " |
| 3-5 | 3.0 | | 0.007 | " | " |
| 4-1 | 0 μ | 25° C. 65% RH | 0.025% | 97 | 12 |
| 4-2 | 0.1 | | 0.024 | " | " |
| 4-3 | 0.3 | | 0.018 | " | " |
| 4-4 | 0.5 | | 0.014 | " | " |
| 4-5 | 3.0 | | 0.013 | " | " |
| 5-1 | 0 μ | 25° C. 75% RH | 0.028% | 100 | 12 |
| 5-2 | 0.1 | | 0.025 | " | " |
| 5-3 | 0.3 | | 0.022 | " | " |
| 5-4 | 0.5 | | 0.018 | " | " |

TABLE 15-continued

| Sample No. | Thickness of Layer of Vinylidene Chloride Copolymer | Heat sealed by closing Temperature | Dimensional Change | Photographic Property Relative Temperature(1) | $\gamma$(2) |
|---|---|---|---|---|---|
| 5-5 | 3.0 | | 0.015 | " | " |

In Table 15 above;
(1)The relative sensitivity is a relative value of the reciprocal of the exposure amount giving a density of 1.5 at 34° C. and for 30 seconds, with the value of sample 5-1 begin defined as 100.
(2)

$$\gamma = \frac{3.0 - 0.3}{-(\log A - \log B)}$$

A: The exposure amount giving a density of 0.3
B: The exposure amount giving a density of 3.0

Samples 2–3 to 2–5 and samples 3–3 to 3–5 are samples of this invention and other samples are comparison samples.

As is clear from the results shown in Table 15 above, the samples having a support prepared by coating both surface of a polyester film with the vinylidene chloride copolymer at a thickness of at least 0.3 μm (per layer) which were heat sealed in a moisture proof bag under a relative humidity of from 40% to 55% showed good dimensional stability without any reduction in the photographic properties.

EXAMPLE 17

To a silver iodobromide emulsion (mean grain size 0.25μm) containing 1 mol% of silver iodide and iridium in an amount of $4\times10^{-7}$ mol per mol of silver were added the sodium salt of 5,5'-dichloro-9-ethyl-3,3'-bis(3-sulfopropyl)oxacarbocyanine as a sensitizing dye, 4-hydroxy-6-methyl-1,3,3*a*,7-tetraazaindene and polyethylene glycol as stabilizers, and hydrazine derivative (I-1) as a contrast increasing agent in an amount of $4.0\times10^{-3}$ mol per mol of silver. furthermore, polymer 3 was added as a polymer latex in an amount as shown in Table 16. Also, the gelatin hardening agent described in Example 1 was used for the emulsion layer The silver halide emulsion was coverage of 4 g/m$^2$ and a gelatin coverage of 3 g/m$^2$ and furthermore a protective layer of formula in Example 1 was formed on the emulsion layer. Also, a backing layer of formula (4) in Example 1 was formed on the side of the support opposite the emulsion layer side. After drying, the coted film was cut into a sheet of 25 cm ×25 cm.

After allowing each cut sheet to stand for 24 hours in an atmosphere at 25° C. and 30% RH, 25° C. and 40% RH, 25° C. and 55% RH, 25° C. and 75% RH, the sheet was heat sealed in a moisture proof bag as used in Example 16 used the same conditions as above, and the sheet was allowed to stand for 3 weeks in the sealed state to provide samples 21-1 to 28-4 as shown in Table 16 below.

Than, for each of the samples, the dimensional change upon processing was measured as in Example 16.

The processing was performed using an automatic processor FG-660/G, developer GR-Dl, and fixing solution GR-Fl (trade names, made by Fuji Photo Film Co., Ltd.) for 30 seconds at 34° C.

The results obtained are shown in Table 16 below.

In addition, the relative sensitivity and $\gamma$ value shown in the table have the same meaning as described in Table 16 above. Samples 26-2, 26-3, 27-2, and 27-3 in the table are samples of this invention and other samples are comparison samples.

TABLE 16

| Sample No. | Support | Amount of Polymer-Latex | Heat sealed by closing Temperature | Dimentional Change | Photographic Property Relative Temperature[1] | $\gamma^2$ |
|---|---|---|---|---|---|---|
| 21-1 | Support of Sample I-1 | 0 g/m$^2$ | 25° C. 30% RH | 0.023% | 98 | 15 |
| 21 " | 1.2 | " | 0.018 | 95 | 15 | |
| 21-3 | " | 1.8 | " | 0.018 | 92 | 14 |
| 21-4 | " | 2.7 | " | 0.017 | 80 | 9 |
| 22-1 | " | 0 g/m$^2$ | 25° C. 40% RH | 0.025% | 99 | 17 |
| 22-2 | " | 1.2 | " | 0.019 | 97 | 17 |
| 22-3 | " | 1.8 | " | 0.018 | 94 | 16 |
| 22-4 | " | 2.7 | " | 0.017 | 82 | 10 |
| 23-1 | " | 0 g/m$^2$ | 25° C. 55% RH | 0.027% | 100 | 17 |
| 23-2 | " | 1.2 | " | 0.021 | 98 | 17 |
| 23-3 | " | 1.8 | " | 0.019 | 95 | 16 |
| 23-4 | " | 2.7 | " | 0.017 | 83 | 10 |
| 24-1 | " | 0 g/m$^2$ | 25° C. 75% RH | 0.030% | 101 | 17 |
| 24-2 | " | 1.2 | " | 0.025 | 99 | 17 |
| 24-3 | " | 1.8 | " | 0.023 | 96 | 16 |
| 24-4 | " | 2.7 | " | 0.020 | 84 | 10 |
| 25-1 | Support of Sample I-4 | 0 g/m$^2$ | 25° C. 30% RH | 0.013% | 98 | 15 |
| 25-2 | " | 1.2 | " | 0.006 | 95 | 15 |
| 25-3 | " | 1.8 | " | 0.005 | 92 | 14 |
| 25-4 | " | 2.7 | " | 0.005 | 80 | 9 |
| 26-1 | " | 0 g/m$^2$ | 25° C. 40% RH | 0.013% | 100 | 17 |
| 26-2 | " | 1.2 | " | 0.006 | 98 | 17 |
| 26-3 | " | 1.8 | " | 0.005 | 95 | 16 |
| 26-4 | " | 2.7 | " | 0.005 | 83 | 10 |
| 27-1 | " | 0 g/m$^2$ | 25° C. 55% RH | 0.014% | 100 | 17 |
| 27-2 | " | 1.2 | " | 0.006 | 98 | 17 |
| 27-3 | " | 1.8 | " | 0.005 | 95 | 16 |

TABLE 16-continued

| Sample No. | Support | Amount of Polymer-Latex | Heat sealed by closing Temperature | Dimentional Change | Photographic Property Relative Temperature[1] | $\gamma^2$ |
|---|---|---|---|---|---|---|
| 27-4 | " | 2.7 | " | 0.005 | 83 | 10 |
| 28-1 | " | 0 g/m$^2$ | 25° C. 75% RH | 0.020% | 101 | 17 |
| 28-2 | " | 1.2 | " | 0.015 | 99 | 17 |
| 28-3 | " | 1.8 | " | 0.014 | 96 | 16 |
| 28-4 | " | 2.7 | " | 0.013 | 84 | 10 |

As is clear from the results shown in Table 16, when the dimensional change of a photographic film is reduced using a large amount of a polymer latex, the contrast increasing action is reduced but according to this invention, the dimensional stability is greatly improved by using a proper amount of polymer latex for giving bad influences on the photographic properties.

While the invention has been described in detail and with reference to specific embodiments thereof, it will be apparent to one skilled in the art that various changes and modifications can be made therein without departing from the spirit and scope thereof.

What is claimed is:

1. A silver halide element comprising, in sequence:
(i) a biaxially oriented polyester support having a thickness of 40 to 200 μm.
(ii) a polymer layer on both surfaces of said polyester support, and
(iii) at least one hydrophilic colloid layer containing from 0.01 to 1.0 parts by weight of a polymer latex per 1.0 part by weight of a binder in said hydrophilic colloid layer, on at least one side of said polyester support,
wherein at least one of said hydrophilic colloid layers is a silver halide emulsion layer, and wherein said polymer layer consists essentially of a copolymer containing from 50–99.5% by weight vinylidene chloride and 50 0.5% by weight of at least one comonomer, and wherein each polymer layer has a thickness of at least 0.3 μm.

2. The silver halide photographic element as claimed in claim 1, wherein the silver halide photographic element has been wound around a core under such conditions that the surface temperature of the coated layer of the photographic element being wound is from 40° to 50° C.

3. The silver halide photographic element as claimed in claim 2, wherein said wound photographic element has been allowed to stand for at least 8 hours in a packed state in a heat insulating packaging material.

4. A silver halide photographic element as claimed in claim 1, wherein the copolymer contains from 70 to 99.5% by weight of vinylidene chloride.

5. A silver halide photographic element as claimed in claim 1, wherein the surface of the polymer support has been subjected to a glow discharge treatment.

6. A silver halide photographic element as claimed in claim 1, wherein a hydrazine derivative is contained in a silver halide photographic element.

* * * * *

UNITED STATES PATENT AND TRADEMARK OFFICE

CERTIFICATE OF CORRECTION

PATENT NO. : 4,954,430

DATED : September 4, 1990

INVENTOR(S) : Kunio Ishigaki et al

It is certified that error appears in the above-identified patent and that said Letters Patent is hereby corrected as shown below:

At column 44, line 14, please change "50 0.5%" to --50 to 0.5%--

Signed and Sealed this

Fifth Day of May, 1992

*Attest:*

*Attesting Officer*

DOUGLAS B. COMER

*Acting Commissioner of Patents and Trademarks*